US011597643B2

(12) United States Patent
Horz

(10) Patent No.: US 11,597,643 B2
(45) Date of Patent: Mar. 7, 2023

(54) CONTAINER FOR STORING A LIQUID, PRESSURE VALVE THEREFOR AND USE OF THE CONTAINER AS A BEER BARREL; METHOD FOR CONTROLLING THE PRESSURE IN A CONTAINER OF THIS TYPE; HOLLOW CONTAINER BASE, MODULAR SYSTEM FOR PRODUCING A HOLLOW CONTAINER BASE AND METHOD FOR FILLING A CONTAINER

(71) Applicant: Envases Oehringen GmbH, Oehringen (DE)

(72) Inventor: Peter Horz, Kisselbach (DE)

(73) Assignee: ENVASES OEHRINGEN GMBH, Oehringen (DE)

( * ) Notice: Subject to any disclaimer, the term of this patent is extended or adjusted under 35 U.S.C. 154(b) by 586 days.

(21) Appl. No.: 16/326,631

(22) PCT Filed: Aug. 21, 2017

(86) PCT No.: PCT/IB2017/055044
§ 371 (c)(1),
(2) Date: Dec. 6, 2019

(87) PCT Pub. No.: WO2018/037332
PCT Pub. Date: Mar. 1, 2018

(65) Prior Publication Data

US 2021/0206618 A1 Jul. 8, 2021

(30) Foreign Application Priority Data

Aug. 20, 2016 (EP) ..... 16185057
Sep. 26, 2016 (EP) ..... 16190516
Jan. 20, 2017 (EP) ..... 17152529

(51) Int. Cl.
*B67D 1/04* (2006.01)
*B65D 83/66* (2006.01)
(Continued)

(52) U.S. Cl.
CPC ..... *B67D 1/0437* (2013.01); *B65D 83/663* (2013.01); *B67D 1/0802* (2013.01);
(Continued)

(58) Field of Classification Search
CPC .. B67D 1/0437; B67D 1/1252; B67D 1/0802; B67D 2001/0822; B67D 2001/0824; B65D 83/663
See application file for complete search history.

(56) References Cited

U.S. PATENT DOCUMENTS 2,112,637 A * 3/1938 Swem ..... F25D 3/12 222/401
2,345,081 A * 3/1944 Ward ..... B67D 1/0456 141/15
(Continued)

FOREIGN PATENT DOCUMENTS

DE 69900940 T2 8/2002
DE 20005017072 U1 12/2006
(Continued)

OTHER PUBLICATIONS

International Search Report and Written Opinion in International Application No. PCT/IB2017/055044, dated Mar. 20, 2018.
(Continued)

*Primary Examiner* — Nicolas A Arnett
(74) *Attorney, Agent, or Firm* — Troutman Pepper Hamilton Sanders LLP

(57) ABSTRACT

A container whose content can be removed easily by a consumer. The container should be inexpensive to produce while being extremely easy to operate by the consumer,
(Continued)

should provide a high degree of flexibility with respect to the choice of the propellant gas (pressure and type of gas) and should achieve a long storage life for the contents, even after the container has been tapped. The container comprises a fill chamber (40), a pressure chamber (6) and a pressure valve (10). The fill chamber (40) is formed by a container base (2), a container wall (7) and a container upper face (8), and a first pressure ($p_B$) prevails in the fill chamber (40). The pressure chamber (6) is formed by the container base (2) and a pressure chamber base (5) and a second pressure ($p_D$) prevails in the pressure chamber (6). The pressure valve (10) is connected to the container base (2) and the pressure chamber base (5). The pressure valve (10), when open, establishes fluid communication between the fill chamber (40) and the pressure chamber (6), and the pressure valve (10), when closed, separates the fill chamber (40) and the pressure chamber (6) in a fluid-tight manner from one another.

13 Claims, 12 Drawing Sheets

(51) Int. Cl.
*B67D 1/08* (2006.01)
*B67D 1/12* (2006.01)
*B65D 83/14* (2006.01)

(52) U.S. Cl.
CPC ..... *B67D 1/1252* (2013.01); *B65D 83/14* (2013.01); *B67D 2001/0824* (2013.01)

(56) References Cited

U.S. PATENT DOCUMENTS

| | | | | | |
|---|---|---|---|---|---|
| 2,630,942 | A | | 3/1953 | Shaffer | |
| 3,055,553 | A | | 9/1962 | Mapes et al. | |
| 3,127,059 | A | * | 3/1964 | Lawrence | B67D 1/0418 222/54 |
| 3,228,559 | A | * | 1/1966 | Couffer | B67D 1/0418 222/61 |
| 3,347,417 | A | * | 10/1967 | Puster | B67D 1/0406 222/61 |
| 3,995,778 | A | * | 12/1976 | Gamadia | A61K 8/8147 222/399 |
| 4,095,624 | A | * | 6/1978 | Davis | B01J 7/00 141/18 |
| 9,790,019 | B2 | * | 10/2017 | Brouwer | B65D 83/20 |
| 2013/0074978 | A1 | * | 3/2013 | Rasmussen | B67D 1/0443 141/2 |
| 2017/0113915 | A1 | * | 4/2017 | Wolthers | B67D 1/0412 |

FOREIGN PATENT DOCUMENTS

| | | | |
|---|---|---|---|
| DE | 202005017072 | U1 | 12/2006 |
| WO | 2009123448 | A1 | 10/2009 |

OTHER PUBLICATIONS

International Preliminary Report and Patentability International Application No. PCT/IB2017/055044, dated Feb. 21, 2019.
Examination Report from Brazilian Application No. BR112019003230-4 dated Jan. 11, 2022.

* cited by examiner

CONTAINER FOR STORING A LIQUID, PRESSURE VALVE THEREFOR AND USE OF THE CONTAINER AS A BEER BARREL; METHOD FOR CONTROLLING THE PRESSURE IN A CONTAINER OF THIS TYPE; HOLLOW CONTAINER BASE, MODULAR SYSTEM FOR PRODUCING A HOLLOW CONTAINER BASE AND METHOD FOR FILLING A CONTAINER

The present inventions relate to the technical field of packaging technology. In particular, the present invention relates to a container whose content can be removed easily by a consumer, and is especially under increased internal pressure compared with the external pressure. In particular, a further invention relates to a pressure valve for the container referred to. In particular, a still further invention relates to a control method for the pressure in a container. In addition, a further invention relates to a hollow container base and a modular system for producing a hollow container base. Furthermore, a further is invention relates to a method for filling a container.

The container is comparatively voluminous, considerably larger than a common beverage can and its content is a beverage to be tapped under pressure.

Portable beer barrels, those with a volume of less than 50 liters, in particular less than 20 liters and more than 2.5 liters, the contents of which can be tapped independently by the consumers themselves, are of particular importance in two common variants.

One variant of such portable beer barrels with a metallic jacket can be emptied by the effect of gravity. A tap is here located in the lower part of the outer side of the container. The beer can flow out by opening the tap. In order to prevent negative pressure from developing in the container, such containers comprise a device that allows air from the environment to enter the interior of the container. Such containers are not very user-friendly, since for filling a glass with beer, the barrel must be placed e.g. at the edge of a table or the barrel must be placed on some kind of substructure so that the glass can be filled underneath the tap. In addition, the storage life of the barrel contents after the barrel has been opened is substantially reduced by atmospheric oxygen flowing in when the beer flows out.

Another variant are containers that comprise an internal pressure system. These systems keep the pressure in the interior above the ambient pressure. This allows the tap to be positioned in the upper area of the container. In this way, a consumer will typically have enough space between the lower discharge end of the tap and the plane on which the container stands for placing a glass to be filled under the tap without special positioning of the container being necessary. Due to the use of internal pressure systems, the storage life of the beer can be as long as 30 days and more after the barrel has been opened, since no atmospheric oxygen will flow into the barrel during the beer extraction process.

A beer barrel system of the second variant is accessible to the person skilled in the art from WO 1999/47451 (Heineken Technical Services). There, a beer barrel system is described, which comprises a pressure cartridge that is arranged inside the container space filled with beer and that generates an overpressure in this space. The pressure cartridge comprises activated carbon, which means that, in comparison with a cartridge comprising no activated carbon, a larger amount of pressurized gas or propellant gas can be introduced into the cartridge, without excessively increasing the pressure in the cartridge. In trade and sales, these cartridges are referred to as "carbonators".

On the market, this system has proven to be the best working solution for portable beer barrels with a content of less than 20 liters for many years. It became the market standard, so to speak. As regards the possible versatility of the filled-in propellant gas, the flexibility is, however, limited, since the filler purchases such cartridges already filled with propellant gas and installs them in the beer barrels (as metallic containers), the filling with beer being carried out by the filler later on.

In addition, the material of the "carbonator" consists of a metal other than the material of the wall of the beer barrel. In the recycling process, this leads to mixed scrap (e.g. material of the wall of the "carbonator" and material of the outer wall of the beer barrel), the avoidance of which will receive more and more attention in the future.

U.S. Pat. No. 2,345,081 (Ward) that dates back to 1944 relates to a siphon (a dispenser for mineral waters). The latter has a base construction with a pressure chamber for intermediate storage of a gas under a pressure significantly above atmospheric pressure. The gas can be discharged in a controlled manner via a valve construction VB into a chamber (a fill chamber LC) filled with liquid (mineral water, but not beer). The pressure chamber has, on both axial ends, a respective wall that is curved inwards (into the pressure chamber). For providing the primary pressure in this pressure chamber, a high-pressure cartridge GB is attached (screwed on with a bushing) to the lower end of the siphon (as a container), so that the siphon can no longer stand on a flat floor (or a flat table).

The objects to be achieved by the invention(s) are providing a system that is inexpensive to produce while being extremely easy to operate by a consumer, providing a high degree of flexibility with respect to the choice of the propellant gas (pressure and type of gas) and achieving a long storage life for the contents, even after the container has been tapped.

The respective object is achieved by a container with a pressure chamber and a pressure valve (claim 1), which is filled with a liquid in its fill chamber (claim 17) or used as a portable barrel (claim 18) having an upper and a lower limit as a filling volume.

Also a method for controlling the pressure in the fill chamber of the container (claim 19) solves the problem.

Likewise, a specially configured metallic container, which is adapted to accommodate a pressure valve on the base side thereof, solves the problem (claims 41, 42). In addition, the object is achieved by a hollow container base comprising two bases, the pressure valve being here connected to the first base and the second base (claim 20 or 34).

The modular system (claim 26 or 38) allows the production of a hollow container base.

The object is also achieved by a method for filling a container (claim 30), which need not necessarily be the container according to claim 1.

A claimed container for storing a liquid comprises a fill chamber (also: filling chamber), a pressure chamber and a pressure valve. The fill chamber is formed by a container base, a container wall and a container upper face, and a first pressure prevails in the fill chamber. The pressure chamber is formed by the container base and a pressure chamber base and a second pressure prevails in the pressure chamber. The pressure valve is connected to the container base and the pressure chamber base. In the open condition of the pressure valve, the pressure valve establishes fluid communication between the fill chamber and the pressure chamber. In the closed condition of the pressure valve, the pressure valve separates the fill chamber and the pressure chamber in a fluid-tight manner from one another (claim 1).

When the second pressure in the pressure chamber is higher than the ambient pressure and/or the pressure in the fill chamber, the container base and the pressure chamber base will be acted upon by respective forces which are directed outwards from the interior of pressure chamber base. Depending on the pressure difference and the thickness of the material of the pressure chamber base and of the container base, the container base and/or the pressure chamber base may be deformed or they may bulge. Due to the fact that the pressure valve is connected to the container base and the pressure chamber base, part of the forces can be absorbed by the pressure valve.

In the case of a constant pressure difference, this will allow the use of a material thickness of the container base and/or of the pressure chamber base that is smaller than a material thickness that would be necessary for avoiding a deformation or bulging of the container base and/or of the pressure chamber base. With a constant material thickness, the arrangement of the pressure valve will allow a higher differential pressure (e.g. high pressure in the pressure chamber) and simultaneously prevent the above-mentioned deformation or bulging.

Fluid communication means that an exchange of fluid between two chambers (e.g. the fill chamber and the pressure chamber) is possible, in particular without delay and not slowly. Fluid-tight means that practically no exchange of fluid can take place between two is chambers; a person skilled in the art will be aware that a perfect sealing off of two chambers, without any exchange of fluid or flow of fluid taking place, is virtually not realizable. A parasitic flow or exchange will always be given, so that the exchange will practically not be substantial. A marginal flow of fluid or exchange of fluid will also take place between two chambers that are separated from one another in a fluid-tight manner, the pressure difference between the two chambers having an influence on the amount of parasitically exchanged fluid per unit time. In any case, the fluid exchange in the closed condition of the pressure valve, i.e. fluid-tight, will be much smaller than the fluid exchange in the open condition of the pressure valve, i.e. when fluid communication exists.

The container base and the pressure chamber base may each have an opening. The pressure valve can engage these openings, whereby a force resulting from a pressure difference between the pressure chamber and the fill chamber and the pressure chamber and the surroundings can be absorbed (claim 2).

The pressure valve may comprise a pressure valve body. The upper and the lower end of the pressure valve may each have arranged thereon a respective projection, the upper and the lower projections protruding each in the r-direction beyond at least a radial part of the pressure valve body at least along part of the circumference of the latter (claim 3). The projections (at the top and at the bottom) may be formed along the entire circumference of the pressure valve or along part of the circumference. Also a plurality of projections may be provided for each axial end of the pressure valve (at the top and at the bottom), and each of these projections may be formed along part of the circumference.

Preferably, the projection on the upper end of the pressure valve contacts the upper side of the container base and the projection on the lower end of the pressure valve contacts the lower side of the pressure chamber base (claim 4). In this way, the force acting on the container base and the pressure chamber base and resulting from the above described pressure difference, can, in turn, be absorbed by the pressure valve at least partially.

The projections of the pressure valve may comprise a sealing element. Depending on the structural design of the projections (at the top and at the bottom of the pressure valve), a plurality of sealing elements may be arranged on each side of the pressure valve, or only one sealing element or sealing elements may be arranged on a projection or on projections of one side of the pressure valve. By providing a sealing element, an improved leakproofness can be achieved at the contact point between the pressure valve and the container base and/or the pressure chamber base.

The container may comprise a discharge line having one end and another end. The first end may be positioned in the fill chamber. Typically, a consumer can remove (tap) a content from the fill chamber via the discharge line. The container base may, in the inner area thereof, be configured to be curved or fully dome-shaped in the direction of the fill chamber.

This means that at least a section of the container base is curved. A (first) distance exists between the lower end of a section of the discharge line positioned in the fill chamber and a point on the pressure chamber base (the surface of the pressure chamber base). Preferably, the distance is the shortest distance between a point on the pressure chamber base and the end positioned in the fill chamber. The shortest distance can be determined by selecting a point on the pressure chamber base having the smallest distance from the discharge line end positioned in the fill chamber. The distance between the above described end of the interior section of the discharge line and the pressure chamber base may be shorter (smaller) than a distance between the above described end of the discharge line and the apex of the curved base section. If an opening (for the pressure valve) is already provided there, it is the edge of the opening of the container base (claim 5). Also in this case, an apex can be extrapolated (at the center of the opening).

Even if the container base is at least partially curved or fully dome-shaped and has a central opening, namely an opening at a point of the container base where the apex would be located on the container base, if there were no opening in the container base or if the opening were located elsewhere, the container base has an apex. In this case, the apex can be determined by extrapolation and is located at a point at which the apex would be located on the container base, if there were no opening in the container base or if the opening were located elsewhere.

Due to the arrangement of the end of the discharge line close to the pressure chamber base, the content of the container can be removed (almost completely) in an advantageous manner through the discharge line, in particular if the content is a liquid that tends to foam, e.g. beer, and if the filling level in the fill chamber is low.

In other words, the lowest point (or the lowest circumferentially extending groove) of the fill chamber is below the highest point of the container base. The former is located at a radially outward position, the latter is located at the center. The end of the discharge line protrudes into the groove.

If gas flows from the pressure chamber via the pressure valve into the fill chamber, a considerable part of the liquid in the fill chamber may be foamed up. In view of its low density, the foam spreads above and laterally to the outlet and accumulates primarily close to the boundary surface in the fill chamber. A consumer would remove a substantial amount of foam from the container, if the inner end of the discharge line were located too close to the valve.

Surprisingly enough, it turned out that the described arrangement of the discharge line end in the fill chamber relative to the container base and the pressure chamber base improves the removal of the content. Less foam is removed.

In the case of a container with a discharge line, also a z-axis may be defined by the container. The z-axis extends therein from or through the pressure chamber base in the direction of the container upper face. Accordingly, the numerical value for the pressure chamber base on the z-axis will be lower than that for the container upper face. The end of the discharge line cannot be arranged above (i.e. on the same level or below) the pressure valve with respect to the z-axis (claim 6). This arrangement provides the above described advantage of a removal of a smaller amount of undesired foam.

In a container with a discharge line and a z-axis, as described above, the container base may be curved or dome-shaped. In this case, at least a section of the container base is curved or dome-shaped. An end of the discharge line, in particular an end located in the fill chamber, cannot be positioned above (same level or below) the apex or the edge of an opening of the container base (claim 7). That which has been described above for determining the apex also applies to this container. Also this embodiment provides the advantage of a reduced removal of foam from the fill chamber.

The pressure in the pressure chamber may exceed the pressure in the fill chamber by at least 1 bar. Preferably, the pressure in the pressure chamber exceeds the pressure in the fill chamber by at least 2 bar, particularly preferred by at least 3 bar (claim 8).

If the pressure in the pressure chamber is higher than the pressure in the fill chamber, a comparatively large amount of propellant gas (high pressure) can be stored in the pressure chamber and the pressure in the fill chamber can simultaneously be (relatively) lower. This leads to a better and, throughout different degrees of filling of the fill chamber, more stable removal behavior. Each pressure valve disclosed in this application may be a control valve.

The pressure chamber may be filled with a propellant gas. The propellant gas consists is preferably of carbon dioxide ($CO_2$), nitrogen ($N_2$), nitrous oxide ($N_2O$) or of mixtures of these gases (claim 9).

Preferably, the pressure in the pressure chamber is between 5 bar (0.5 MPa) and 35 bar (3.5 MPa), specifically between 5 bar and 30 bar, more specifically between 8 bar and 25 bar (claim 10). The pressure in the pressure chamber is also determined through the volume of the pressure chamber, so that the pressure can be lower if the volume of the pressure chamber is larger, and the amount of substance remains constant, or can be higher if the pressure chamber has a larger volume.

The pressure in the fill chamber may be lower than the pressure in the pressure chamber. Specifically, the pressure in the fill chamber may be between 1.2 bar (0.12 MPa) and 7 bar (0.7 MPa), more specifically between 1.5 bar and 6 bar, and even more specifically between 1.7 and 5 bar (claim 10).

The volume of the pressure chamber may be between 0.1 l and 5 l, specifically between 0.1 l and 3 l, more specifically between 0.5 l and 2.5 l, even more specifically between 0.5 l and 1.5 l (claim 11).

The volume of the fill chamber may be between 1 l and 25l, specifically between 2 l and 20 l (claim 11). Preferably, the fill chamber has a volume that allows to accommodate 2 l, 3l, 5 l or 20 l of a liquid, so that preferably, in addition to the liquid in the fill chamber, a gas-filled area of at least 0.05 l exists.

The pressure chamber may not contain a filler. A filler is a component that typically exists in a solid physical state under environmental conditions and that allows to accommodate a certain amount of a substance. The increase in pressure caused by introducing the substance in the space, in which the filler has been inserted, is lower in comparison the introduction of the same amount of a substance into the same space containing no filler.

The vapor pressure of the propellant gas or of the propellant gas mixture may be higher than the pressure in the pressure chamber, specifically down to a temperature of −5° C. (claim 12). Accordingly, most of the propellant gas or propellant gas mixture in the pressure chamber is present in gaseous form, the person skilled in the art being aware of the fact that, even in this state, a (very) small part of the propellant gas or propellant gas mixture is present in liquid form (cf. the surface-energy or surface-tension effects on strongly curved surfaces).

The fact that most of the propellant gas is present in the form of gas, improves the safety of the container in comparison with a propellant gas filling, a substantial amount of which is present in the form of a liquid. If a considerable amount of the propellant gas is liquid at room temperature and below room temperature, heating of the container (e.g. if a consumer exposes the container to intensive sunlight and/or high temperatures for a prolonged period of time) may have the effect that a phase transformation from the liquid to the gaseous phase takes place, whereby a substantial increase in pressure may occur. This may result in failure of the wall material of the pressure chamber. In addition, such an increase in pressure by phase transformation is problematic, when a consumer uses the container for the first time.

Within the scope of the present invention, the arrangement of the pressure valve in the container allows, in the event of a very high increase in pressure within the pressure chamber, the overpressure to be discharged to the surroundings via the pressure chamber base, which may possibly lead to a destruction of the pressure valve. This is advantageous compared to the prior art, since in the case of prior art containers the entire container will normally burst, if a critical pressure is exceeded.

Preferably, the container base is, at least in the radial inner area, configured to be curved upwards or fully dome-shaped, perhaps except for the outer edge area. Specifically, the container base is configured to be curved in the z-direction towards the container interior (towards the fill chamber). In particular, the apex or the edge of an opening of the container base protrudes in the direction of the filling volume for the liquid (claim 13).

Due to a curvature of the container base, a chamber can be formed making use of not more than two components (here the container base and the pressure chamber base). In addition, the force absorption of the curved component is better than that of a non-curved component. Furthermore, an inwardly curved container base (curved towards the fill chamber) allows emptying of a filled container to a lower filling level, since, in comparison with a flat container base or a container base that is curved in a different z-direction, an increased filling height (the cross-sectional area being smaller) will be obtained, when the residual filling quantity remains constant, in the edge area of the fill chamber of the container, cf. in this respect U.S. Pat. No. 2,345,081 (Ward) that has been referred to and assessed at the beginning.

The pressure chamber base may be substantially planar, in particular the pressure chamber base is substantially parallel to the container upper face (claim 14). The "substantially"

allows a deviation of 10% from planarity and parallelism. This is sufficient for mounting a metallic base sleeve, which extends between the two openings of the bases and is sealingly connected thereto. In this way, the deviation from planarity can be used for applying a tension to the base sleeve, the container base being slightly deflected upwards, and the base sleeve is mounted at the top in a tensioning manner.

The base sleeve relieves the actual functional valve from axial forces. The functional valve can be inserted into the already mounted base sleeve and is mounted therein in an axially non-displaceable manner.

The pressure chamber base may be configured such that, when the container stands upright on a flat underlying surface, the pressure chamber base will not be in contact with the flat underlying surface.

Preferably, the container base, the pressure chamber base, the container wall and/or the container upper face are formed of a metal sheet having a respective wall thickness of less than 1.0 mm. In particular, the wall thickness is less than 0.8 mm, even more preferred less than 0.55 mm (claim 15).

A small material thickness (wall thickness) of the components of the container allows the container to be used in a particularly economic manner as a disposable container. A disposable container is typically disposed of by a consumer after use and is not reused.

Each of the containers disclosed in the present application may be a barrel, in particular a beer barrel.

A pressure valve for a container may comprise a pressure valve body, a first pressure valve chamber, a second pressure valve chamber and a third pressure valve chamber. The first pressure valve chamber is defined by the pressure valve body and a first movable piston. The second pressure valve chamber is delimited by the pressure valve body, the first movable piston and a second movable piston. The second pressure valve chamber is, via a fill chamber channel, in fluid communication with a first space located outside the pressure valve. The third pressure valve chamber is delimited by the pressure valve body and the second piston and is, via a first pressure chamber channel, in fluid communication with a second space located outside the pressure valve. The first and the second movable piston are preferably motion-guided and, in particular, a movement can take place essentially only in an axial direction (z-direction). "Essentially" means here that, in the case of a use in accordance with the present invention, the axial movability is the main movability. The first space located outside the pressure valve may be any space located outside the pressure valve, and in particular it will be a fill chamber. Likewise, the second space located outside the pressure valve may be any space located outside the pressure valve. Preferably, this space is the pressure chamber. As regards the fluid communication, the statements made hereinbefore are referred to.

The pressure valve body may comprise a second pressure chamber channel, which, in the closed condition of the pressure valve, is closed in a fluid-tight manner at one end of the second pressure chamber channel by the first piston and which is open on a second end towards the second space located outside the pressure valve.

Preferably, the second pressure valve chamber and the second space located outside the pressure valve are in fluid communication via the second pressure chamber channel in the open condition of the pressure valve. In particular, the first space located outside the pressure valve and the second space located outside the pressure valve are in fluid communication in the open condition of the pressure valve.

The pressure valve may comprise a seat valve. In the sealing condition of the seat valve, the pressure valve is closed and in the non-sealing condition of the seat valve, the pressure valve is open.

Preferably, the seat valve comprises a sealing element. The sealing element is defined by a section of the second piston and the sealing element may abut in a fluid-tight manner on a section of the pressure valve body. In particular, the sealing element is conical, spherical or disk-shaped, so that a conical seat valve, a ball seat valve or a disk-type seat valve is obtained.

The first movable piston may be mechanically coupled to the second movable piston as soon as the pressure in the first pressure valve chamber is so high that the first piston will move, in response to the pressure, in the z-direction towards the second piston and enter into contact with the latter. Due to the pressure in the first pressure valve chamber, a force acts on the first piston, depending on the area of the first piston acted upon by the pressure. By overcoming at least a frictional force and possibly a weight force, the first piston will be able to move.

Preferably, the first piston comprises a receiving element, which allows the first piston and the second piston to be coupled.

The first piston may comprise a seal. Preferably, the seal is formed on the piston by means of injection molding or it is an O-ring. In particular, the injection-molded seal may be produced by a 2-component production process (multi-component injection molding).

A tensioning element may be fixed in position between the pressure valve body and the second piston. Preferably, the tensioning element is a spring made of metal or plastic. The tensioning element is provided for holding the second piston at a fixed position relative to the pressure valve body, even if no additional forces act on the elements of the pressure valve.

Preferably, the tensioning element is arranged in the third pressure valve chamber.

The first piston and/or the second piston may comprise no channel. Preferably, at least one of the first and second pistons may be a solid component. The first and/or the second piston may be an integral component.

The pressure valve body may have a pressure valve inlet, which is adapted to be closed in a fluid-tight manner and through which a substance can be introduced in the first pressure valve chamber. The substance is preferably a gas and in particular a propellant gas. Likewise, a substance in liquid or in solid form may be introduced, the phase transformation into the gaseous form taking place later on in the first pressure valve chamber. For example, carbon dioxide may be introduced in the form of dry ice or in liquid form, a sublimation or an evaporation of the non-gaseous carbon dioxide taking place in the first pressure valve chamber.

A container described may comprise a pressure valve described, in particular the pressure valve may be placed in the container on the base-side of the latter.

The fill chamber of a container may be filled with a liquid. Preferably, the liquid is beer (claim 17). Any type of beer is here meant, non-alcoholic and alcoholic beer.

The container described may be used as a portable barrel, the barrel having a filling volume of not more than 20 l, preferably not more than 10 l or 5 l. In particular, the volume is larger than 11 and in particular larger than 21 (claim 18).

The pressure in the fill chamber of an above described container can (automatically) be controlled according to a method. The fill chamber is filled at least partially with a liquid and the pressure chamber is filled at least partially with a propellant gas. The container comprises a discharge line with a valve. In the open condition of the valve, the discharge line establishes fluid communication between the fill chamber and a space surrounding the container. In the course of the method, the valve is actuated, whereby part of the liquid in the fill chamber will be discharged into the space surrounding the container and the pressure in the fill chamber will decrease in accordance with the discharged volume of liquid. If the pressure falls below a threshold value of the pressure in the fill chamber, the pressure valve will open, whereby part of the volume of the propellant gas in the pressure chamber will be caused to flow into the fill chamber. If a second threshold value of the pressure in the fill chamber is exceeded, the pressure valve will close and allow no further flow of propellant gas from the pressure chamber into the fill chamber (claim 19). The first and the second threshold values result from the characteristics of the container and of the pressure valve and will be explained in more detail hereinafter, on the basis of an embodiment.

The method may comprise an above described pressure valve.

A metallic container can store therein a liquid, preferably beer, under pressure. The container comprises a fill chamber for the liquid and a pressure chamber for a propellant gas. The fill chamber is formed between an upwardly curved container base and a container upper face. The fill chamber accommodates the liquid and a first overpressure in comparison with the exterior. The pressure chamber is formed between the container base and a pressure chamber base located further down (when the container stands upright). The pressure chamber accommodates a second overpressure of a propellant gas. The container base has provided therein a first opening, and the pressure chamber base has provided therein a second opening, the openings being in axial alignment for receiving therein a pressure valve that closes and seals off both openings (claim 41).

A hollow container base can be used for a container. The hollow container base comprises a first base and a second base as well as a pressure valve. Both the first and the second base have a respective opening. The first base is connected to the second base. The pressure valve is connected to the first base and the second base. In this way, a fluid-tight pressure chamber is formed. In the open condition of the pressure valve, the pressure chamber is in fluid communication with a space surrounding the hollow container base (claim 20).

In the closed condition of the pressure valve, the pressure chamber is separated in a fluid-tight manner from a space surrounding the hollow container base.

Preferably, the first base and/or the second base is/are made of steel, iron or aluminum. The pressure valve consists preferably of plastic, in particular of a thermoplastic material, specially preferred the pressure valve consists of two or three different thermoplastic materials.

In particular, the container base as well as the container wall, the container upper face and the pressure chamber base may be made of tinplate.

The first base of the hollow container base may have a curved shape or may be dome-shaped (claim 21).

The pressure valve of the hollow container base may engage a respective opening of the first base and of the second base (claim 22).

Preferably, the pressure valve of the hollow container base has at least one respective projection on the upper and on the lower end (axial). The projection on the upper end contacts the outer surface of the first base and the projection on the lower end contacts the outer surface of the second base.

Preferably, a pressure $p_{D3}$ that is higher than the atmospheric pressure prevails in the pressure chamber (claim 23). This overpressure may be caused by a propellant gas comprising in particular carbon dioxide, nitrogen, nitrous oxide or mixtures of these gases.

The first base of the hollow container base may engage over the second base of the hollow container base, preferably the second base is fully enclosed by the first base in the axial direction. In addition, the edge area of the first base may be configured such that the hollow container base is connectable, via the first base, to a container. This connection may especially be realizable by flanging (claim 24).

The pressure valve may be connected in the hollow container base with the first base and the second base such that forces acting on the first base and the second base through an overpressure in the pressure chamber will be absorbed, at least partially, by the pressure valve (claim 25). This leads to an improved stability of the hollow container base when an overpressure prevails in the pressure chamber.

A modular system for producing a hollow container base comprises a first base, a second base and a pressure valve. The first base comprises an opening and a circumferentially extending bead. The second base comprises an opening. The pressure valve comprises a respective projection on the (axial) upper end and on the (axial) lower end thereof. The first base and the second base are connectable via the bead of the first base. The pressure valve is connectable to the first base and the second base such that the projection on the upper (axial) end of the pressure valve contacts the upper surface of the first base and the projection on the lower (axial) end of the pressure valve contacts the lower surface of the second base (claim 26).

The first base of the modular system may be curved or may be dome-shaped (claim 27).

The pressure valve of the modular system may engage a respective opening of the first base and of the second base (claim 28).

By the combination (connection) of the components of the modular system, viz. of the first base, the second base and the pressure valve, a fluid-tight pressure chamber can be formed in the closed condition of the pressure valve (claim 29).

A container comprising a fill chamber, a pressure chamber and a pressure valve can be filled according to a method. The fill chamber is formed by a container base, a container wall and a container upper face. A first pressure $p_{B4}$ prevails in the fill chamber. The pressure chamber is formed by the container base and a pressure chamber base. A second pressure $p_{D4}$ prevails in the pressure chamber, the pressure being higher than the atmospheric pressure. In particular, the second pressure $p_{D4}$ is higher than 3 bar. The pressure valve is connected to the container base and the pressure chamber base. The pressure valve comprises a pressure valve inlet. The container comprises a fill chamber inlet. In the course of the method, a liquid is filled into the fill chamber via the fill chamber inlet. According to an embodiment, a gas is filled into the pressure valve via the pressure valve inlet. The pressure valve inlet is closed (claim 30). In this way, an activating force is generated in the pressure valve. According to an alternative, the same purpose is achieved in a different way, in particular by pretensioning a tensioning element, whereby a force is applied to a diaphragm and the diaphragm moves in a positive z-direction. An activation takes place also in this case (claim 30).

Preferably, the method steps are carried out in the following sequence:

filling the liquid into the fill chamber via the fill chamber inlet, filling a gas into the pressure valve via the pressure valve inlet and closing the pressure valve inlet.

The pressure valve may have connected thereto a cover via at least one web. For closing the pressure valve inlet, the cover may be applied to the pressure valve inlet, whereby the pressure valve inlet is closed (claim 31). Preferably, the cover is applied to the pressure is valve inlet through a substance-to-substance bond.

The cover may be connected to the pressure valve or applied to the pressure valve inlet by friction welding, in particular by ultrasonic welding (claim 32).

By filling a gas into the pressure valve via the pressure valve inlet, a first piston of the pressure valve can be moved until the first piston enters into contact with a second piston of the pressure valve or abuts thereon (claim 33).

Preferably, the gas filled into the pressure valve is carbon dioxide, nitrogen, nitrous oxide or a mixture of these gases.

The embodiments of the present invention are illustrated by examples and are not disclosed in a manner that transfers or reads restrictions from the figures into the claims. These examples are to be read and considered as examples even in the event that "by way of example", "in particular" or "e.g." is not used everywhere and in every place. Nor should the description of an embodiment be read such that there is no other embodiment or that other possibilities are excluded, if only one example is presented. These provisos should be read into the entire description following hereinafter.

FIG. 1 shows a schematic representation of a container 1 in cylindrical coordinates (coordinates z, r and φ) with a fill chamber 40, a pressure chamber 6 and a pressure valve 10.

FIG. 2 shows a sectional view through the base region 1*a* of a container 1 in the z-direction with a detailed representation of a pressure valve 10 that is in particular adapted for base-side use and base-side installation.

FIG. 3 shows a sectional view in the z-direction of a container base region 1*a* without a base-side pressure valve 10.

FIG. 4 shows a sectional view in the z-direction of a pressure valve 10 for base-side installation, with a first piston 12 and a second piston 13 being coupled.

FIG. 5 shows a sectional view in the z-direction of another pressure valve 10*a* for base-side installation, the first piston 12 and the second piston 13 being here not coupled.

Figure 12A:
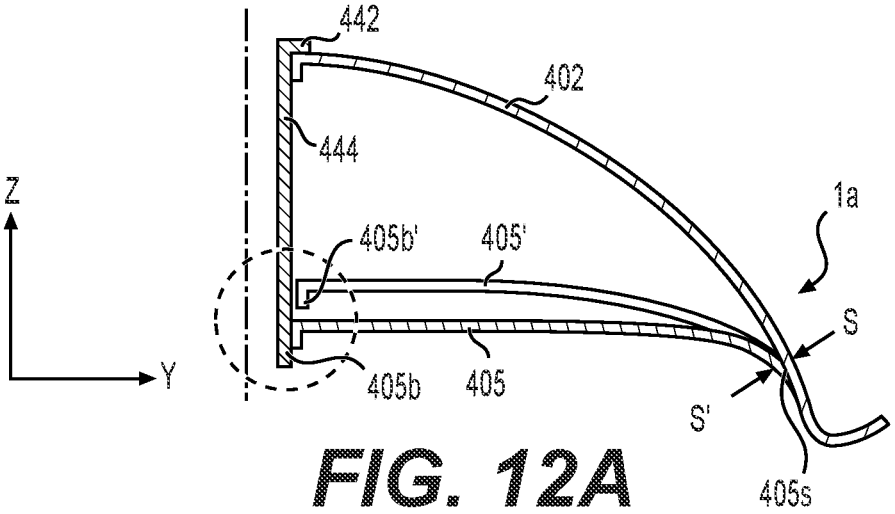

FIG. 12*a* shows a method step during the connecting of a (metallic) sleeve 444 to the container base 402 as well as the pressure chamber base 405.

Figure 12B:
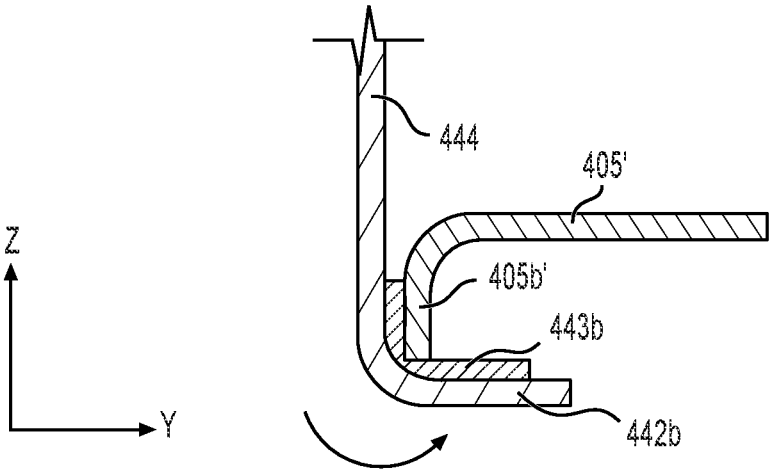

FIG. 12*b* shows a further method step during the connecting of the sleeve 444 to the pressure chamber base 405.

Figure 12C:
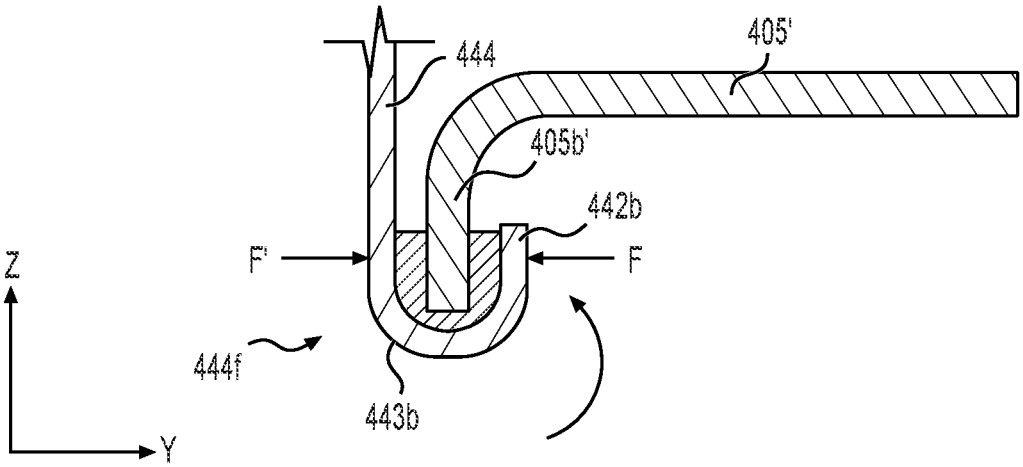

FIG. 12*c* shows a method step during the connecting of the sleeve 444 to the pressure chamber base 405.

Figure 1:
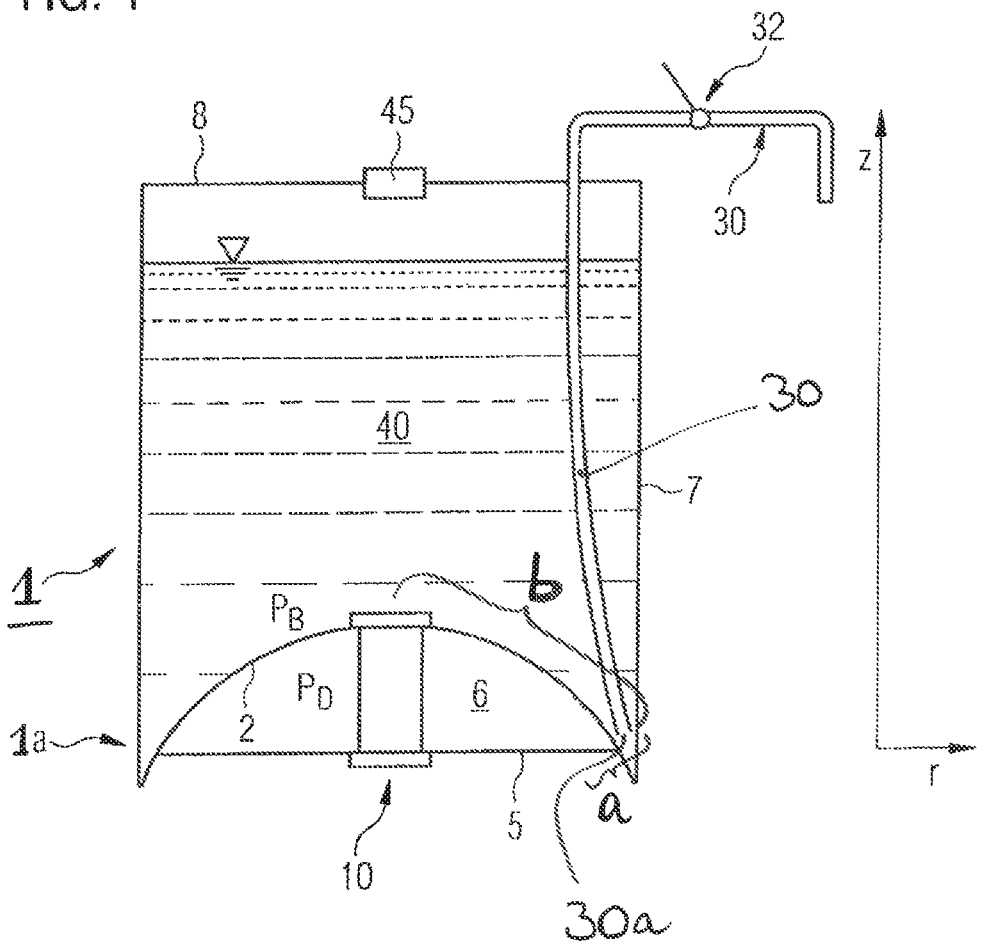

An embodiment of a container 1 is schematically shown in FIG. 1. In the upper area of the container 1 a fill chamber 40 is arranged. The fill chamber 40 is partially filled with a liquid and the uppermost area of the fill chamber 40 is filled with a gas. The fill chamber 40 is defined by a container wall 7, a container upper face 8 and a container base 2. In the lower area of the container 1, a pressure chamber 6 is provided, which is defined by the container base 2 and the pressure chamber base 5. A pressure valve 10 connects the container base 2 and the pressure chamber base 5 and extends through the pressure chamber 6. A pressure $p_B$ prevails in the fill chamber 40 and a pressure $p_D$ prevails in the pressure chamber 6. The pressure $p_D$ in the pressure chamber 6 is higher than the pressure $p_B$ in the fill chamber 40.

In this filled condition of the container 1, the liquid in the fill chamber 40 causes the prevailing pressure to depend on the axial height in the fill chamber 40. The pressure $p_B$ is the pressure that is effective on the fill chamber side of the pressure valve. In the embodiment according to FIG. 1, the pressure $p_B$ corresponds to the pressure in the gas-filled area of the fill chamber 40 plus the pressure component resulting from the liquid column up to the height on which the pressure $p_B$ acts on the pressure valve 10 from the fill chamber side.

The pressure $p_B$ in the fill chamber 40 is higher than the ambient pressure of the container 1, so that, when a valve 32 is opened, the liquid in the fill chamber 40 will flow out of a discharge line 30. As the liquid in the fill chamber 40 flows out, the pressure $p_B$ decreases in accordance with the volume of liquid removed. If the pressure falls below a certain level (discussed in detail hereinafter), the pressure valve 10 will open and a propellant gas will flow from the pressure chamber 6 into the fill chamber 40 until a certain pressure is reached in the fill chamber 40. Then, the pressure valve 10 closes and no further gas can flow from the pressure chamber 6 into the fill chamber 40. In this way, it is ensured that the pressure $p_B$ in the fill chamber 40 will always be sufficiently high to allow the liquid content of the fill chamber 40 to flow out via the discharge line 30 in response to opening of the valve 32.

Due to the curvature of the container base 2 in the direction of the container interior, a small-area region (base region 1*a*) is formed in the edge area of the lower area of the fill chamber 40, so that residual amounts of liquid in the fill chamber 40 are easily accessible by the discharge line 30 and only a (very) small amount of liquid cannot be removed.

The end 30*a* of the discharge line 30, which is located in the fill chamber 40, projects in the z-direction down to a point below the upper surface of the pressure valve 10 into the base region 1*a*. The purpose of this arrangement is to space apart a foam, which may possibly be generated by a liquid in the fill chamber 40 while a gas is flowing or after a gas has flown from the pressure chamber 6 into the fill chamber 40, from this end 30*a* of the discharge line 30, so that a small amount of foam and a large amount of non-foamed liquid can be removed via the discharge line 30.

The end of the discharge line 30 located in the fill chamber 40 is also positioned below the apex of the curved container base 2 in the z-direction and, according to FIG. 3, also below the edge of the opening 2*a* in the container base 2. This opening of the container base 2 is engaged by the pressure valve 10.

In addition, the first distance a between the end of the discharge line 30 in the fill chamber 40 and the pressure chamber base 5 is smaller than the second distance b between the end 30*a* of the discharge line 30 in the fill chamber 40 and the apex of the container base 2 (alternatively the edge of the opening of the container base 2 through which the pressure valve 10 extends).

The container base 2 is configured to be at least partially curved or fully dome-shaped and projects into the container interior in the positive z-direction. The apex and the edge of the opening of the container base 2 project in the direction of the interior 40 of the container 1.

At the container upper face 8, a fill chamber inlet 45 is arranged, through which the fill chamber 40 can be filled with a liquid and, optionally, a first overpressure can be applied.

Figure 2:
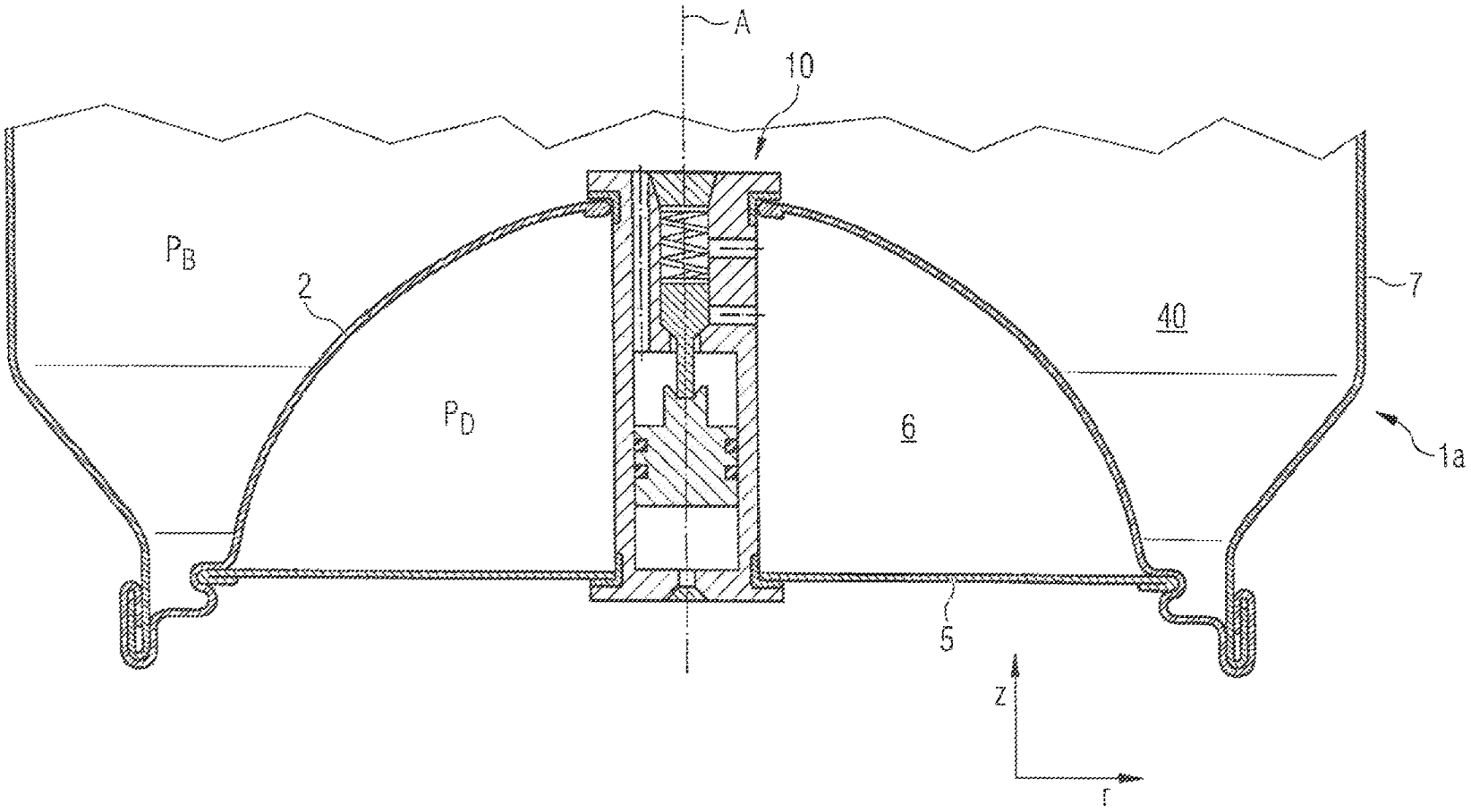

FIG. 2 shows a sectional view through the base region 1*a* of a container 1 with a detailed representation of a pressure valve 10. The container base region 1*a* shows a lower area of the fill chamber 40, the pressure chamber 6 and the pressure valve 10. The container base 2 is connected to the container wall 7 via a fold. The pressure chamber base 5 is connected to the container base 2. Openings of the container base 2 and of the pressure chamber base 5 are engaged by the pressure valve 10. The pressure valve 10 is here configured such that forces directed outwards from the pressure chamber 6 and acting on the container base 2 and the pressure chamber base 6 are absorbed, at least partially, by the pressure valve 10.

Figure 3:
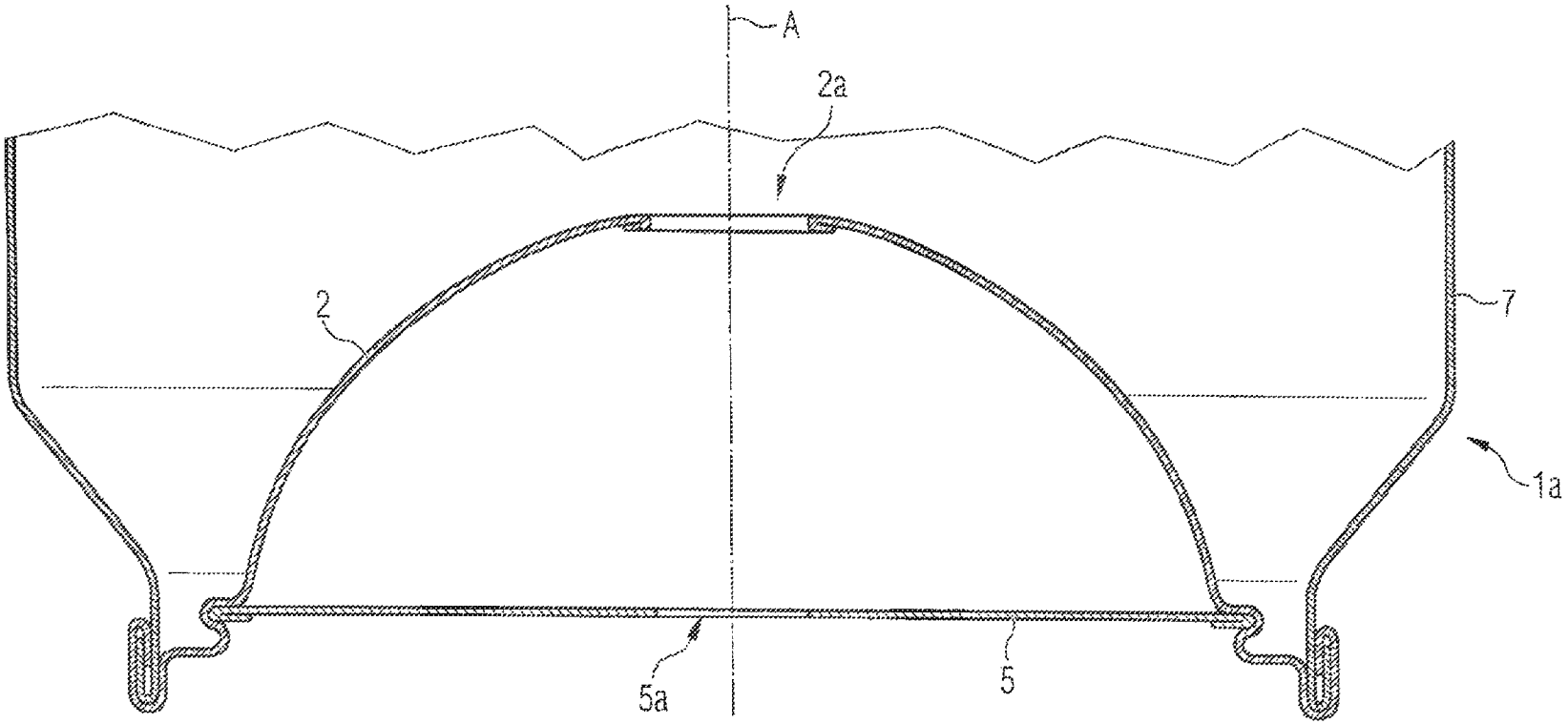

FIG. 3 shows a sectional view of a container base region 1*a* in the z-direction similar to the embodiment in FIG. 2, but without the pressure valve 10. The container base 2 has an opening 2*a* and the pressure chamber base 5 has an opening 5*a*. In the present embodiment, the openings 2*a*, 5*a* are in axial alignment (z-direction) along the axis A.

For placing a pressure valve 10 into the openings 2*a*, 5*a* in the way shown e.g. in FIG. 2, the pressure valve 10 is e.g. bipartite.

Such a bipartite structural design of the pressure valve can be connected, e.g. via a threaded joint, to form a one-piece pressure valve 10, one part of the pressure valve 10 having an external thread and another part of the pressure valve 10 an internal thread that matches the external thread. The pressure valve 10 can be placed in the pressure chamber 6, e.g. by inserting one part of the pressure valve into one of the two openings 2*a*, 5*a*, inserting the second part of the pressure valve 10 into the other one of the two openings 2*a*, 5*a* and connecting the two pressure valves by screwing. In this way, the openings 2*a*, 5*a* are sealingly closed and the pressure valve 10 is connected to the container base 2 and the pressure chamber base 5.

Figure 4:
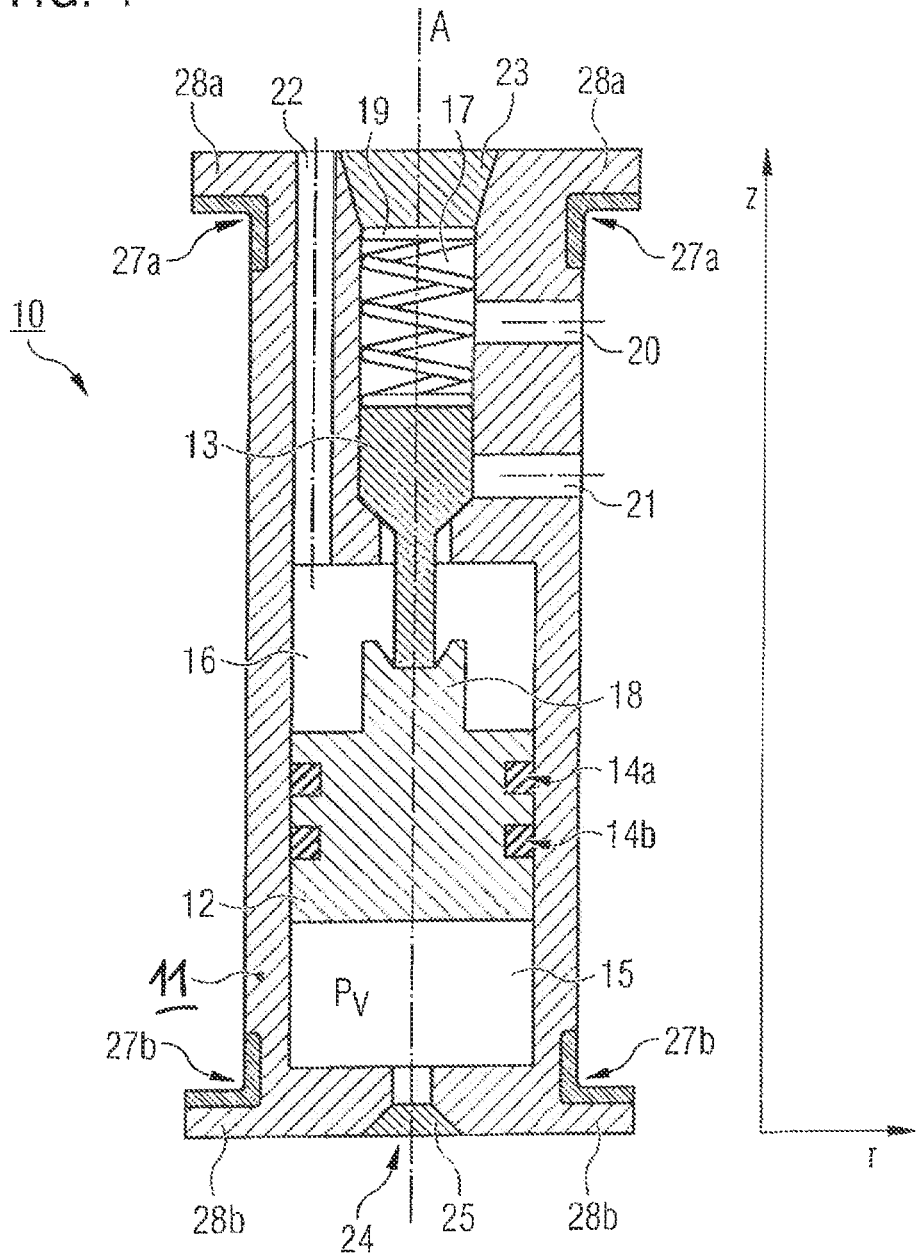

FIG. 4 shows a sectional view in the z-direction of an embodiment of a pressure valve 10 for base-side installation in a container 1, as described above. The pressure valve 10 comprises a first pressure valve chamber 15, in which a pressure $p_V$ prevails. The first pressure valve chamber 15 is delimited by a pressure valve body 11 and a first piston 12. The pressure valve body 11 has provided therein a pressure valve inlet 24, through which the first pressure valve chamber 15 can be filled with a gas. The pressure valve inlet 24 is adapted to be closed in a fluid-tight manner by a cover 25. In addition, the pressure valve comprises a second pressure valve chamber 16 delimited by the pressure valve body 11, the first piston 12 and a second piston 13. The second pressure valve chamber 16 is in fluid is communication with a space, which is located outside the pressure valve 10, via a fill chamber channel 22. The pressure valve 10 additionally comprises a third pressure valve chamber 17, which is delimited by the second piston 13 and the pressure valve body 11. The third pressure valve chamber 17 is in fluid communication with a space located outside the pressure valve 10, via a first pressure chamber channel.

In the third pressure valve chamber 17, a tensioning element 19 is fixed in position between the pressure valve body 11 and the second piston 13. In the present embodiment, the tensioning element 19 is a spring. By means of the tensioning element 19, a conical portion of the second piston 13 is held in a counterstructure formed in the pressure valve body 11, so that the conical portion of the second piston 13 acts as a conical seat valve. In this condition, with the conical portion of the second piston 13 sealingly abutting on the counterstructure of the pressure valve body 11, the pressure valve 10 is closed. In the closed condition of the pressure valve 10, the space located outside the fill chamber channel 22 is separated in a fluid-tight manner from the space located outside the first pressure chamber channel 20.

The lower and the upper end of the pressure valve 10 have arranged thereon a respective projection 28*a*, 28*b*. The projections 28*a*, 28*b* project radially (r-direction) beyond the radial dimensions of the pressure valve body 11. These projections 28*a*, 28*b* improve the fit of the pressure valve 10, when the pressure valve 10 is placed in the openings 2*a*, 5*a* of the container base 2 and of the pressure chamber base 5 (cf. FIGS. 2 and 3). The respective sides of the projections 28*a*, 28*b* facing the pressure valve center and a respective axial portion of the pressure valve body 11 have arranged thereon sealing elements 27*a*, 27*b*. When the pressure valve 10 is placed in the openings 2*a*, 5*a* of the container base 2 and of the pressure chamber base 5, the sealing elements 27*a*, 27*b* abut, accordingly, on the upper side of the container base 2 and on the lower side of the pressure chamber base 5. This leads to improved leakproofness.

The first piston 12 has arranged thereon two seals 14*a*, 14*b*. In the present embodiment, the seals 14*a*, 14*b* are configured as O-rings. Likewise, the seals 14*a*, 14*b* may be realized as seals formed on the piston 12 by injection molding. By means of the seals 14*a*, 14*b*, the first pressure valve chamber 15 and the second pressure valve chamber 16 are more effectively separated from one another in a fluid-tight manner and cause most of the frictional force when the first piston 12 moves.

In the condition shown in FIG. 4, a gas has been introduced into the first pressure valve chamber 15, so that a sufficiently high pressure $p_V$ prevails in the first pressure valve chamber 15 for overcoming the frictional force between the first piston 12 and the seals 14*a*, 15*b*, respectively, and the pressure valve body 11 as well as the force of gravity. As a result, the first piston 12 has moved in the positive z-direction until the receiving element 18 contacts the end face of the second piston 13.

An equilibrium of forces prevails in the pressure valve 10. The first piston 12 is acted upon, in the positive z-direction, by a force resulting from the pressure $p_V$ in the first pressure valve chamber 15 in combination with the area of the first piston 12 to which the pressure $p_V$ is applied. In addition, a force acts in the positive z-direction, which results from the pressure in the space outside the fill chamber channel 22 that is applied in an axially effective manner to the conical portion of the second piston 13. In the negative z-direction, a force acts on the first piston 12, which results from the pressure outside the fill chamber channel 22 that is applied to the end face of the first piston 12. Furthermore, forces effective in the negative z-direction are a force, which is applied to the second piston 13 by the tensioning element 19, as well as the gravitational forces of the first and second pistons 12, 13. In the negative z-direction, an additional force is effective, which results from the pressure outside the first pressure chamber channel 20, as far as the pressure is applied to the upper end face of the second piston 13.

When the pressure valve 10 is placed in the container base of a container 1, as shown e.g. in FIGS. 1 and 2, the pressure outside the fill chamber channel 22 corresponds to the pressure $p_B$ of the fill chamber 40 and the pressure outside the first pressure chamber channel 20 corresponds to the pressure $p_D$ of the pressure chamber 6. If the pressure $p_B$ in the fill chamber 40 decreases due to the withdrawal of a volume of liquid, the equilibrium of forces (as shown above) may be changed. If the pressure decrease is sufficiently high, the first and second pistons (coupling) will move in the positive z-direction and the pressure valve 10 will be open. In the open condition of the pressure valve 10, an exchange of fluid via the second pressure chamber channel 21 will take place until the force acting on the first piston 12 in the negative z-direction has become sufficiently strong to displace the first and second pistons 12, 13 in the negative z-direction until a closed condition of the pressure valve is reached. The frictional force between the first piston and the seals 14*a*, 14*b*, respectively, and the pressure valve body 11 is effective in both the positive and the negative z-direction depending on the direction of movement of the first piston 12.

This equilibrium of forces determines the threshold values S1 and S2. The threshold values S1 and S2 result from the geometric design of the pressure valve 10, in particular from the areas acted upon by the pressures shown, and from the pressure levels as well as from the tensioning force of the tensioning element 19.

If the pressure outside the fill chamber channel 22 falls below the first threshold value S1, the pressure valve 10 will open by a movement of the first and second pistons 12, 13 in the positive z-direction. If the pressure outside the first pressure chamber channel 20 exceeds the second threshold value S2, the pressure valve 10 will close by a movement of the first and second pistons 12, 13 in the negative z-direction. If the pressure valve 10 is arranged in a container 1, the pressure outside the fill chamber channel 22 may correspond to the pressure $p_B$ in the fill chamber 40 and the pressure outside the first pressure chamber channel 20 may correspond to the pressure $p_D$ in the pressure chamber 6.

FIG. 4 additionally shows an insert 23 that can be inserted in the pressure valve body 11.

The opening in the pressure valve body 11, into which the insert 23 can be introduced, can be used for introducing, during the production of a pressure valve 10, the tensioning element 19 and the second piston 13 into the interior of the pressure valve 10. When the insert 23 has been mounted in the opening of the pressure valve body 11 provided for this purpose, the insert 23 becomes part of the pressure valve body 11.

The pressure valve body 11 may be bipartite (not shown in FIG. 4), in particular such that one of the two projections 28*a*, 28*b* is arranged on one part of the bipartite pressure valve body 11 and the other one of the two projections 28*a*, 28*b* is arranged on the other part of the bipartite pressure valve body 11. The two parts of the pressure valve body 11 may be adapted to be connected e.g. by a threaded joint. In the connected condition of the two parts, a bipartite pressure valve body 11 is obtained.

Figure 5:
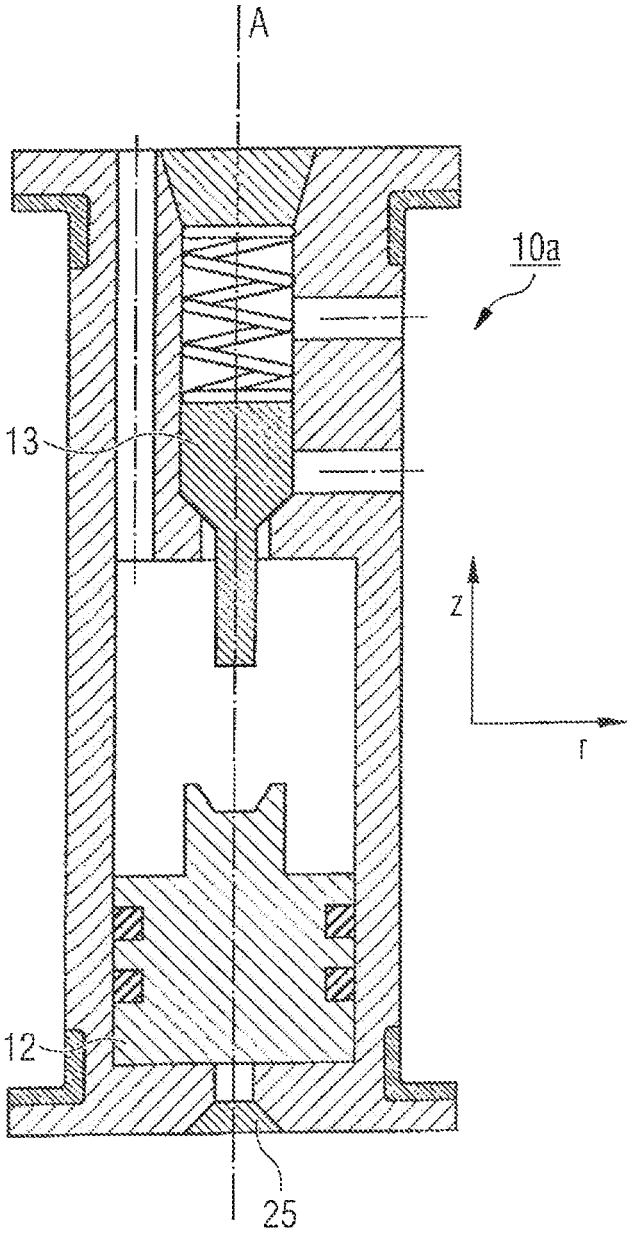

FIG. 5 shows a pressure valve 10*a* for base-side installation in a container 1. The difference to the pressure valve 10 according to FIG. 4 is to be seen in that no gas has been introduced into the pressure valve 10*a* through the pressure valve inlet 24, so that the first piston 12 is not coupled with the second piston 13.

Figure 6:
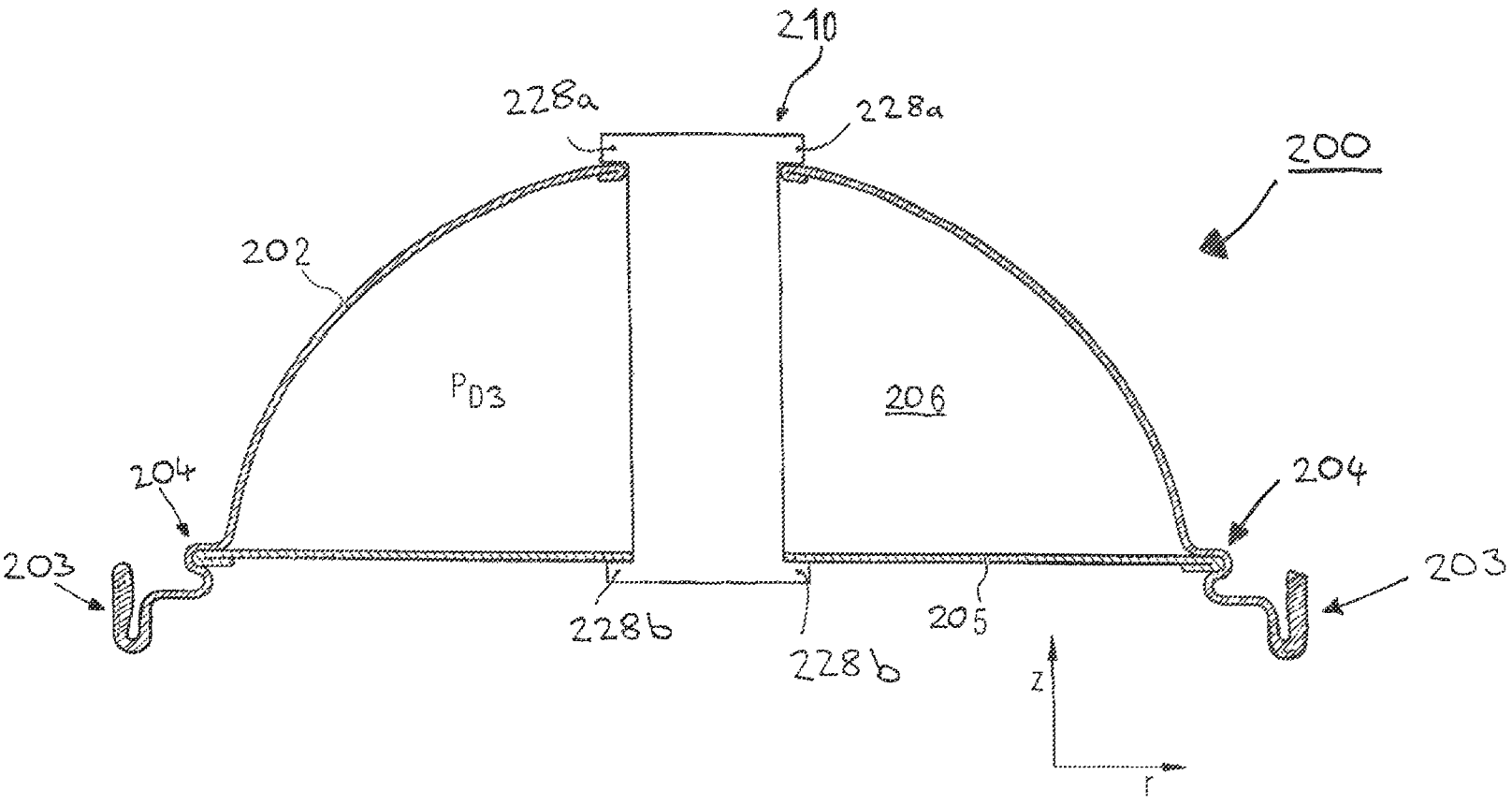
FIG. 6 shows a hollow container base 200.

FIG. 6 shows a hollow container base 200. A pressure chamber 206 is formed in the hollow container base 200. In the pressure chamber 206 a pressure poi prevails. The pressure chamber 206 is sealed off from the surroundings in a fluid-tight manner by a first base 202, a second base 205 and a pressure valve 210, when the pressure valve 210 is closed. When the pressure valve 210 is open, the pressure valve 210 establishes fluid communication between the pressure chamber 206 and a space surrounding the hollow container base 200.

In the pressure chamber 206 there may be an overpressure, which means that the pressure $p_{D3}$ in the pressure chamber 206 is higher than the pressure in the space surrounding the hollow container base 200 or higher than the pressure in the space surrounding the upper portion (in positive z-direction) of the pressure valve. In the case of an overpressure in the pressure chamber 206, a gas flows from the pressure chamber 206 into the surroundings of the hollow container base 200, when the pressure valve 210 is open.

The pressure valve 210 is arranged in respective openings of the first base 202 and of the second base 205. Through such an arrangement of the pressure valve 210, the pressure valve 210 closes the openings of the first base 202 and of the second base 205. In the present embodiment, the openings of the first base 202 and of the second base 205 are in alignment in the z-direction.

The pressure valve 210 has on the upper portion thereof a (completely) circumferentially extending projection 228*a*. The projection 228*a* is arranged such that the outer surface of the first base 202 abuts sectionwise on the projection 228*a*. The lower portion of the pressure valve 210 has arranged thereon a further projection 228*b*, which is arranged such that the outer surface of the second base 205 abuts on the lower projection 228*b*.

Due to this structural design, a force acting on the first base 202 and the second base 205 (in each case from the pressure chamber 206 to the outside) can partially be absorbed by the pressure valve 210 (tensile stress). This allows, with the same pressure difference between the pressure chamber 206 and the space or the spaces outside the bases 202, 205 and with the same stability, a reduction of the material thickness of the first base 202 and/or of the second base 205 in comparison with a material thickness of the bases 202, 205 without force absorption through the pressure valve 210.

In other embodiments, the projections 228*a*, 228*b* may each be configured with circumferential interruptions. The pressure valve 210 may also be arranged on the inner surfaces of the bases 202, 205 (located in the pressure chamber 206), e.g. by a glued joint or a welded joint, whereby force absorption through the pressure valve 210 can be realized.

The second (lower) base 205 is substantially planar (less than 10% deviation from planarity) and is arranged in a fluid-tight manner in a circumferentially extending bead 204 of the first base 202. Also the second base 205 may be connected to the first base 202 by flanging, welding or gluing. In other embodiments, the lower base 205 may not be planar.

The first (upper) base 202 is (sectionwise) curved. In the negative r-direction, from the circumferentially extending bead 204 onwards, the first base 202 is configured as a spherical shell segment or a hollow spherical segment with a central opening.

At the edge area 203 of the first base 202, a junction point or a connection point is arranged for a cylindrical or tubular container, which is not shown in FIG. 6. In the embodiment shown in FIG. 6, the edge area 203 of the first base 202 is configured such that the hollow container base 200 can be connected via the edge area 203 of the first base 202 to a container by flanging.

FIG. 6 also shows an embodiment of a hollow container base that can be designed making use of a modular system.

A modular system comprises a first base 202, a second base 205 and a pressure valve 210 as individual components. Making use of the individual components of the modular system, a hollow container base can be produced.

The modular design allows better transport in comparison with hollow container bases that have already been mounted.

Figure 7:
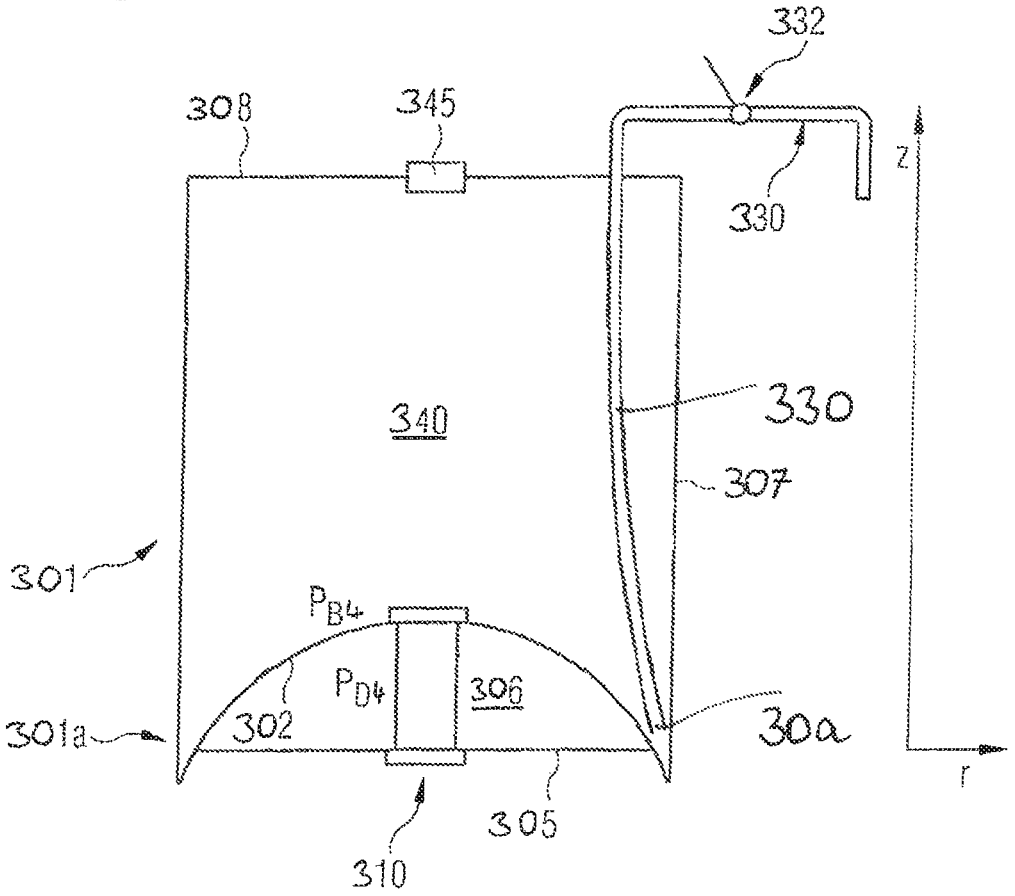
FIG. 7 shows a container 301 to be filled.
Figure 8:
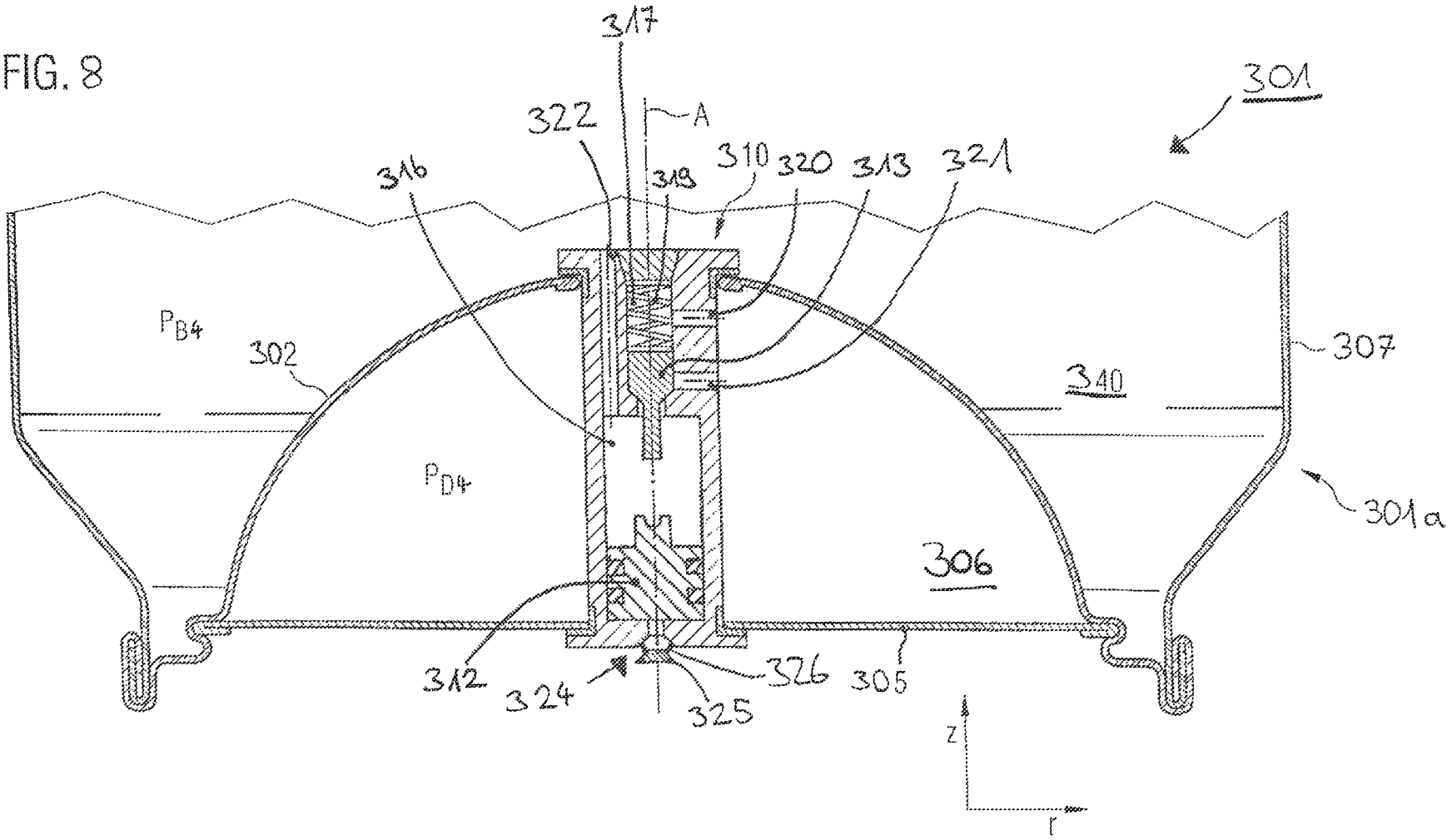
FIG. 8 shows a detail of a filled container 301 before a gas is filled into the pressure valve 310.
Figure 9:
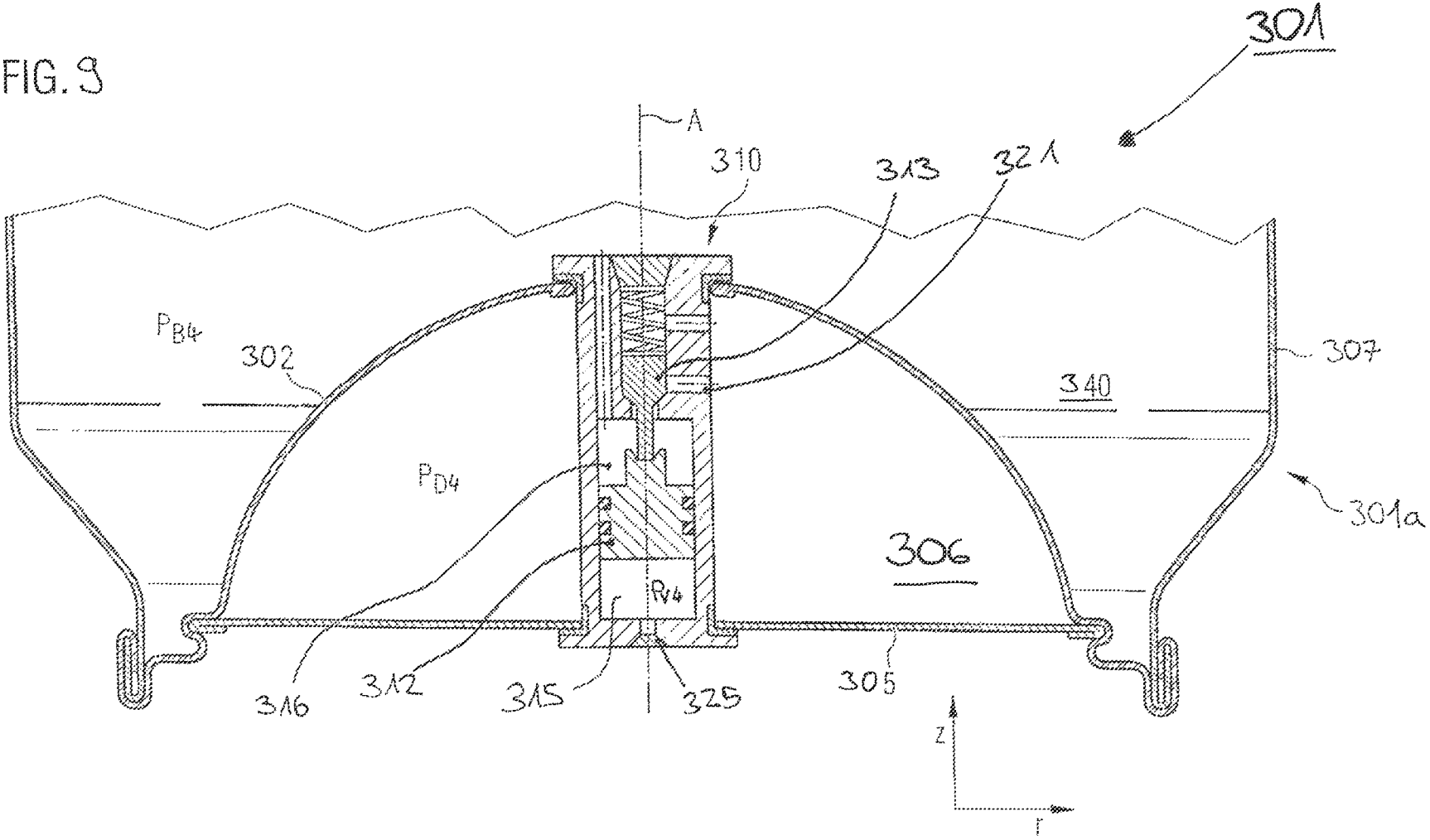
FIG. 9 shows a detail of a filled container 301 after a gas has been filled in the pressure valve 310.

FIGS. 7, 8 and 9 show difference stages during the filling of a container.

The container 301 according to FIG. 7 corresponds to container 1 in FIG. 1 with the difference that the fill chamber 340 (fill chamber 40 in FIG. 1) is not filled with a liquid.

The container 301 comprises a fill chamber 340 formed between a container base 302, a container wall 307 and a container upper face 308. The container upper face 308 comprises a fill chamber inlet 345 and the passage for a discharge line 330. The discharge line 330 comprises a valve 332 and leads in the interior of the fill chamber 340 down into the container base region 301*a* (at the end of the inner section of the discharge line). In the fill chamber 340, a pressure $p_{B4}$ prevails.

The container 301 additionally comprises a pressure chamber 306 formed between the container base 302 and a pressure chamber base 305. The container base 302 and the pressure chamber base 305 each comprise an opening having a pressure valve 310 attached thereto. In the pressure chamber 306, a pressure $p_{B4}$ prevails, the pressure $p_{D4}$ being above the atmospheric pressure (outside the container 301).

Such a container 301 (FIG. 7) can be delivered to a filler of a liquid, e.g. beer, and can be filled at the fillers. For this purpose, the filler will fill a liquid via the fill chamber inlet 345 into the fill chamber 340. The fill chamber inlet 345 is then closed.

FIG. 8 shows, for activating the pressure valve 310, a detailed illustration of a container 301 filled with a liquid (in the fill chamber 340).

The pressure valve 310 comprises a second pressure valve chamber 316, which is in fluid communication with the fill chamber 340 via a fill chamber channel 322. In addition, the pressure valve 310 comprises a third pressure valve chamber 317 having a tensioning element 319 arranged therein, the tensioning element 319 applying a force in the negative z-direction to a second piston 313. The third pressure valve chamber 317 is in fluid communication with the pressure chamber 306 via a first pressure chamber channel 320.

Due to the overpressure in the pressure chamber 306 and the tensioning force of the tensioning element 319, the second piston is positioned in the pressure valve 310 such that the pressure valve 310 is in the closed condition. Accordingly, the second pressure valve chamber 316 is not in fluid communication with the pressure chamber 306 via the second pressure chamber channel 321. Only the pressure $p_{B4}$ in the fill chamber 340 (sum of overpressure and pressure resulting from the liquid column) applies a force to the second piston 313 in the positive z-direction, the forces acting on the second piston 313 in the negative z-direction being, however, greater.

The first piston 312 abuts on the pressure valve 310 at the base. The forces acting on the first piston 312 in the negative z-direction are the weight force of the first piston and a force resulting from the pressure in the second pressure valve chamber 316 in combination with the area across which this pressure is applied to the first piston.

In order to activate the pressure valve 310, an overpressure (pressure above atmospheric pressure) can be introduced into the pressure valve 310 via a pressure valve inlet 324. In the embodiment shown in FIG. 8, a cover 325 is arranged via webs 326 on the pressure valve 310 in the area of the pressure valve inlet 324. The cover 325 serves to close the pressure valve inlet 324 after an overpressure has been introduced in the pressure valve 310 through the pressure valve inlet 324.

By introducing the overpressure, a force (in accordance with the magnitude of the overpressure and the area of application) is applied to the first piston 312, the force being strong enough to make the first piston 312 move in the positive z-direction in a guided manner. To this end, the weight force of the first piston 312, the force resulting from the pressure in the second pressure valve chamber and frictional forces must be overcome. The first piston 312 moves in the positive z-direction until it is in contact with the second piston 313 or, possibly, further in the positive z-direction, if the pressure introduced through the pressure valve inlet 324 is sufficiently high.

FIG. 9 shows a filled container 301 after the overpressure has been introduced through the pressure valve inlet 324 into the pressure valve 310 and the pressure valve inlet 324 has been closed.

A first pressure valve chamber 315 has been formed by the introduction of pressure and this first pressure valve chamber 315 is located below the first piston 312. The first piston 312 separates the second pressure valve chamber 316 from the first pressure valve chamber 315. The cover 325 closes the pressure valve inlet 324.

The closing of the pressure valve inlet 324 can be carried out by friction welding (substance-to-substance bond). Preferably, an ultrasonic lance is applied to the cover 325. When the lance is activated, the cover 325 is connected to the pressure valve 310 by a substance-to-substance bond, and also the webs 326 can thus be connected (by a substance-to-substance bond) to the pressure valve 310 or the connection area between the cover 325 and the pressure valve 310 and need not be removed separately.

Due to the fact that the first piston 312 abuts on the second piston 313, the pistons are mechanically coupled. In addition to the above described forces, also the force of the first piston 312, which acts in the positive z-direction (as a result of force influences acting in the negative and in the positive z-direction), will act accordingly on the second piston 313. If the force acting in the negative z-direction on the first piston 312 decreases due to a reduction of the pressure $p_{B4}$ in the fill chamber 340, the first piston 312 and the second piston 313 can move in the positive z-direction, so that the fill chamber 340 is in fluid communication with the pressure chamber 306 via the second pressure chamber channel 321.

In this form, the pressure valve 310 is in its open condition and a propellant gas can flow from the pressure chamber 306 into the filling chamber 340. This happens until the force influences acting on the first piston 312 and the second piston 313 change in such a way that the first piston 312 and the second piston 313 move in the negative z-direction until the connection between the fill chamber 340 and the pressure chamber 306 will be interrupted. The pressure valve 310 is now closed.

Due to the simple possibility of introducing a gas into the pressure valve 310 via the pressure valve inlet 324 on the part of the filler, the latter can determine the type of gas introduced, e.g. air, carbon dioxide, nitrogen, nitrous oxide or mixtures of these gases, and can determine the pressure in the first pressure valve chamber 315 himself.

For minimizing undesirable diffusive processes, it may be advantageous that the gas introduced via the pressure valve inlet 324 into the pressure valve 310 (first pressure valve chamber 315) corresponds to the composition of the gas introduced in the pressure chamber 306, or that, as regards the composition of the component or components, the deviations are not higher than 20%, preferably not higher than 10%.

Figure 10:
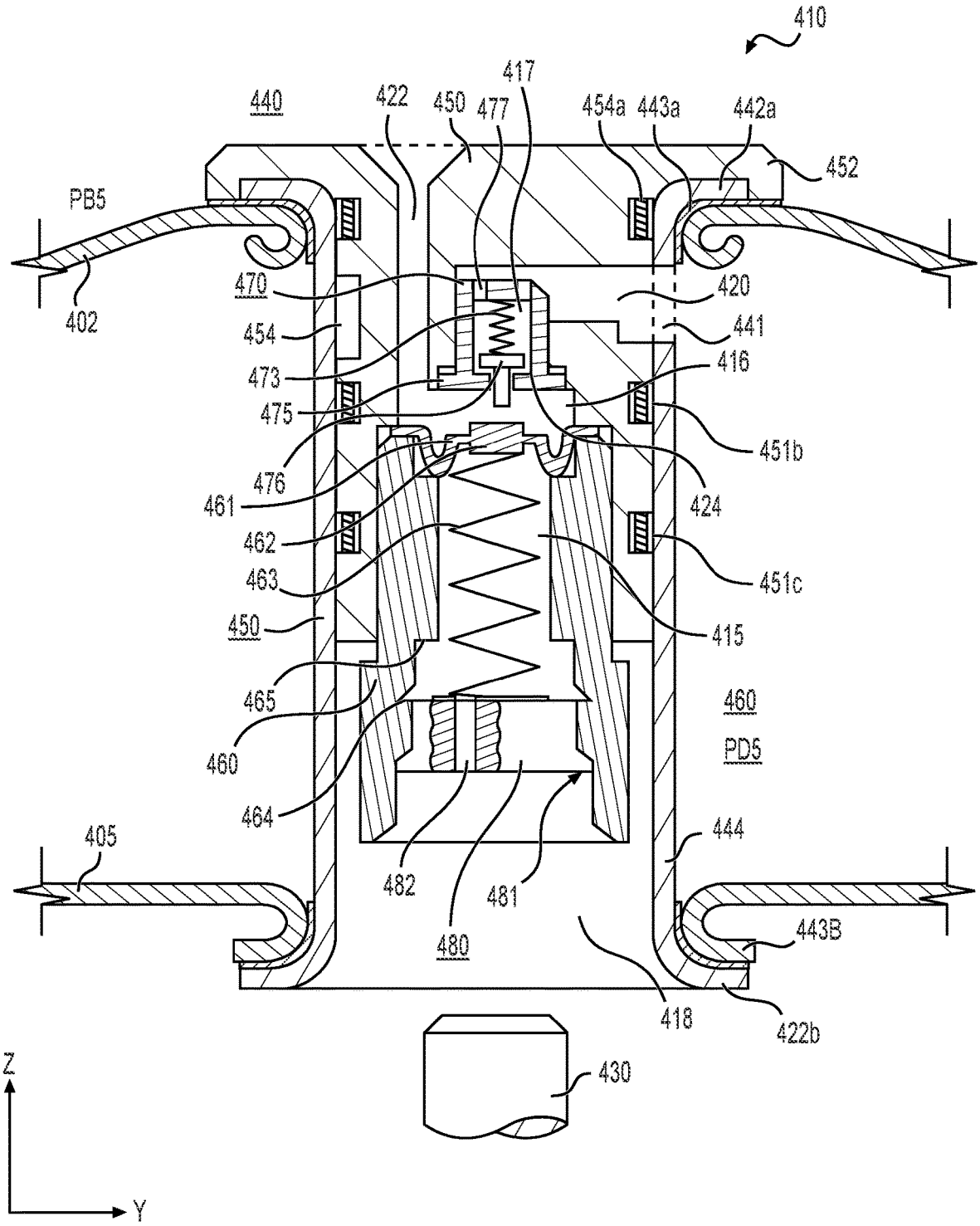
FIG. 10 shows a pressure valve 410 before a closure element 480 to be displaced has entered into locking engagement.

FIG. 10 illustrates a pressure valve 410 (used as a control valve for the pressure in the fill chamber 40), placed in a container. The pressure valve 410 comprises a valve sleeve 444, a first valve insert 450, a second valve insert 460 and a third valve insert 470.

The valve sleeve 444 is made of metal and connected to a container base 402 and a pressure chamber base 405. Alternatively, the metallic sleeve may also be assigned to the container base, in which case it would be a base sleeve whose circumferential surface need not be fully solid, but may also follow the outline of a sleeve in the form of a supporting frame or in a circumferentially distributed rod or grid form.

The sleeve (valve sleeve or base sleeve, depending on the viewing direction) is intended and configured for receiving therein a valve element by axial insertion and for spacing apart the two bases mechanically at a given (fixed) distance.

The connection of the sleeve with the base is established in that the sleeve 444 extends through an opening in the container base 402 and a radial projection 442*a* of the sleeve 444 abuts on the upper surface of the container base 402. The connection of the sleeve 444 with the pressure chamber base 405 is shown in FIG. 10 through a shaped projection 442*b* of the sleeve 444 abutting on a lower surface of the pressure chamber base 405. Both abutments are of a sealing nature for gas under gas pressure and liquids of the type to be accommodated in the container.

The projections 442*a*, 442*b* of the pressure valve sleeve 444 and the container base 402 as well as the pressure chamber base 405 have sealing elements 443*a*, 443*b* arranged between them.

An alternative solution for the connection between the pressure chamber base 405 and the pressure valve sleeve 444 is shown in FIGS. 12*a*, 12*b* and 12*c* and explained in the associated description.

Analogously to the representations according to FIG. 1, most of the pressure valve 410 of FIG. 10 is located in the pressure chamber 406 (corresponds to chamber 6 of FIG. 1), which is defined by the pressure chamber base 405 and the container base 402 (corresponds to base 5 and base 6 of FIG. 1). The pressure chamber 406 may have the above disclosed properties. The pressure $p_{D5}$ in the pressure chamber 406 lies above the ambient pressure, in particular at pressure values of the type described above for pressure chambers.

Due to the overpressure in the pressure chamber 406, a force acts on the container base 402 and the pressure chamber base 405. This force can be absorbed particularly effectively by the sleeve 444, which comprises metal.

The sleeve 444 has inserted therein a control valve, which functionally fulfils the task of controlling the pressure, irrespectively of the task of mechanical stabilization. By its very nature, the control valve may be made of plastic, even though one spring or the other or one metal diaphragm or the other is installed therein.

In an example based on the present figure, the sleeve 444 has inserted therein a first pressure valve insert 450. The first pressure valve insert 450 is arranged in the pressure valve sleeve 444 in a force-fitting manner. The force-fit connection is given by overdimensioning the first pressure valve insert 450 in comparison with the dimensions of the pressure valve sleeve 444. The outer diameter of the sleeve 444 may be smaller than 30 mm. The inner diameter of the sleeve 444 is reduced by twice the wall thickness thereof. The outer diameter of the first pressure valve insert 450 may exceed the inner diameter of the pressure valve sleeve 444 by up to 0.5 mm, preferably between 0.1 mm and 0.3 mm.

In addition to the overdimensioning of the first pressure valve insert 450, a plurality of sealing elements 451*a*, 451*b*, 451*c* provide the force-fit connection with the pressure valve sleeve 444. The sealing elements may be O-ring-shaped.

The first pressure valve insert 450 comprises a first channel 422 (as a fill chamber channel) connecting a (second) chamber 416, which is located in the pressure valve 410, with a fill chamber 440 of the container. In the fill chamber 440, a pressure pas prevails, which is is lower than the pressure pas in the pressure chamber 406.

The first pressure valve insert 450 comprises a second channel 420 (as a pressure chamber channel) which opens into a circumferentially extending groove 454 (as an annular channel) in the first pressure valve insert 450. The sleeve has provided therein an opening 441, which opens into the pressure chamber 406. The pressure valve insert 450 need therefore not be circumferentially adjusted, when it is pressed into the sleeve.

The first pressure valve insert 450 has a radially protruding projection 452, which engages over the radial projection 442*a* of the sleeve 444 and the end area of which abuts on the upper surface of the container base 402.

The first pressure valve body may preferably be made of plastic. A liquid contained in the fill chamber 440 does not come into direct contact with the metallic sleeve 444 in order to avoid corrosion. In addition, it improves the durability of the pressure valve 410.

The first pressure valve insert 450 has connected thereto a second pressure valve insert 460, which will be explained hereinafter.

A third pressure valve insert 470 is arranged between the second chamber 416 and the second channel 420. The third pressure valve insert 470 is connected to the first pressure valve insert 450 in a force-fit or in a form-fit manner.

The third pressure valve insert 470 comprises an opening 477 connecting a (third) chamber 417, which is located in the third pressure valve insert 470, via the second channel 420 to the pressure chamber 406, so that the pressure in the third chamber 417 will (almost) correspond to the pressure $p_{D5}$ in the pressure chamber 406.

In the third chamber 417, a tensioning element 473, in particular a spring, is fixed in position through a tensioning element guide 474. The tensioning element 473 is additionally connected to a sealing disk 475 of a disk valve 475, 476 and presses the sealing disk 475 into a valve seat 476.

The first insert 450 has the second insert 460 connected thereto. The connection can be provided as a force-fit or as a form-fit connection. A threaded joint or a welded joint, in particular through friction welding, is preferred.

The second pressure valve insert 460 comprises a diaphragm 461, which is preferably made of a flexible plastic. The diaphragm 461 has formed thereon a contact element 462 in the form of a portion of increased thickness of the diaphragm 461.

The diaphragm 461 of the second pressure valve insert 460 has formed thereon a further tensioning element 463, in particular a spring. The tensioning element 463 is arranged in a (first) chamber 415, which is located in the second pressure valve insert 460, and exerts a force between the diaphragm 461 and a closure element 480.

In FIG. 10, the closure element 480 is connected to the second pressure valve insert 460 loosely or in an only weakly supporting manner.

Figure 11:
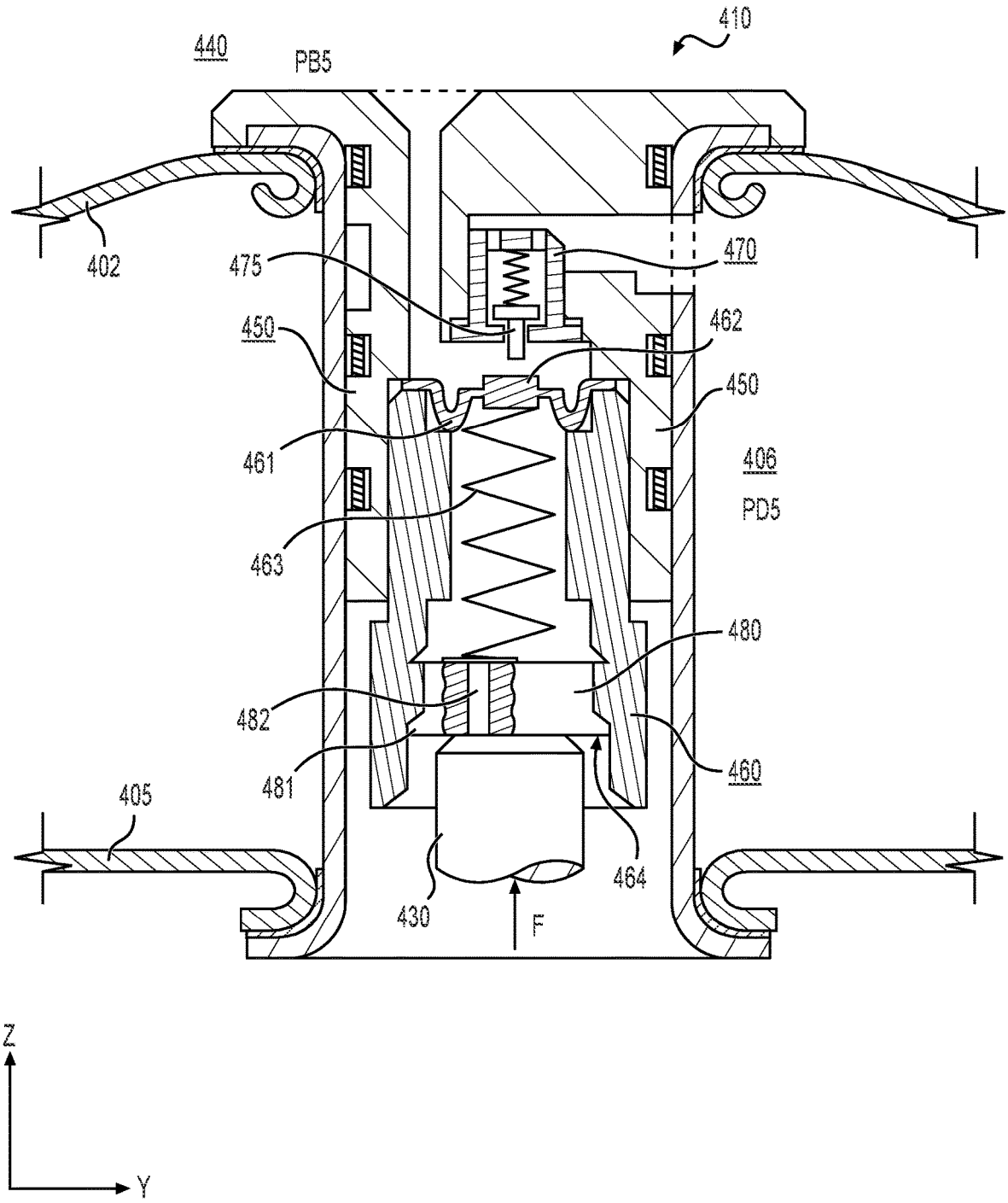
FIG. 11 shows a pressure valve 410 after the axially displaced closure element 480 has entered into locking engagement.

The function of the closure element 480 can best be described by viewing the different states according to FIGS. 10 and 11.

The closure element 480 is not fixedly connected to the contact element 462. It comprises a radial projection 481 and an axial channel 482. The closure element 480 is configured such that it can be inserted into the second pressure valve insert 460 from outside.

To this end, the second pressure valve insert 460 comprises a groove 464 and an annular stop surface 465. The groove 464 is here configured complementarily to the projection 481 of the closure element 480. The distance between the contact surface 465 and the groove 464 is not smaller than the distance between the projection 481 and the upper surface (in the positive z-direction) of the closure element 480.

Via the sleeve 444, which is downwardly (in the negative z-direction) open with respect to the surroundings of the pressure valve 410, the closure element 480 can be introduced, e.g. with the aid of a plunger-like closure device 490, into a (fourth) chamber 418 in the pressure valve sleeve 444 and can be pushed further in the positive z-direction into the second pressure valve insert 460 until the radial projection 481 of the closure element 480 lockingly engages the circumferential groove 464 of the second pressure valve insert 460 and, possibly, the upper surface (in the positive z-direction) of the closure element 480 abuts on (enters into contact with) the contact surface 465 of the second pressure valve insert 460.

This has the effect that the tensioning element 463 is tensioned, whereby a force is applied to the diaphragm 461 and the diaphragm 461 moves in the positive z-direction until it abuts on a section of the sealing disk 475, e.g. through the contact element 462.

In the engaged condition of the closure element 480, the pressure valve 410 is activated and there is an equilibrium of forces between the pressure $p_{B5}$ in the fill chamber 440, the pressure $p_{D5}$ in the pressure chamber 406 and the tensioning elements 463, 473.

The pressure $p_{D5}$ in the pressure chamber acts on the application area of the sealing disk 475 in the negative z-direction. Also a force applied by the tensioning element 473 to the sealing disk 475 acts on the sealing disk 475 in the negative z-direction. In the second chamber 416, the pressure $p_{B5}$ in the fill chamber acts on the application area of the diaphragm 461 in the negative z-direction, the diaphragm 461 being coupled to the sealing disk 475.

A small, in principle negligible force also results from the pressure $p_{B5}$ in the fill chamber 440 in the positive z-direction, which acts on the sealing disk 475 and which is small due to the small or negligible area of application of the pressure $p_{B5}$ on the sealing disk 475.

The tensioning element 463 exerts a force in the positive z-direction on the diaphragm 461, the force being transmitted to the sealing disk 475 due to the fact that the diaphragm 461 and the sealing disk 475 are coupled.

Depending on the application areas of the described elements, the pressures and the tensioning forces of the tensioning elements, a pressure control is obtained in the fill chamber 440.

When a certain volume is removed from the fill chamber 440, e.g. when beer is tapped by a consumer, the pressure pas will decrease in the fill chamber 440, whereby the force influences involved will change and the described equilibrium of forces will cease to exist.

If the pressure falls below a threshold value of the pressure pas in the fill chamber 440, the force influences acting in the positive z-direction will predominate, so that the sealing disk 475 will be raised from the valve seat 476 and a fluid communication will be established between the pressure chamber 406 and the fill chamber 440 until a further threshold value of the pressure pas in the fill chamber 440 is exceeded and the sealing disk 475 moves back into the valve seat 476. As a result, fluid communication between the fill chamber 440 and the pressure chamber 406 is no longer given (until the equilibrium of forces changes again).

In particular through the selection of the tensioning force of the tensioning element 463, with the other conditions remaining constant, different control pressures can be provided.

FIG. 12*a*, 12*b*, 12*c* illustrate a possibility of connecting a mechanically stable sleeve 444 to a container base 402 and a pressure chamber base 405.

First, the metallic pressure chamber base 405 is welded to the metallic container base 402 at 405*s*, as indicated by the two arrows S and S' directed towards one another.

The sleeve 444 can be guided or passed through an opening in the container base 402 and through an opening in the pressure chamber base 405, so that a projection 442*a* of the pressure valve sleeve 444 abuts on the upper surface of the container base.

The opposite end of the sleeve 444 protrudes beyond the opening in the pressure chamber base 405 and abuts on an axial projection 405*b* of the pressure chamber base 405 in a radial orientation. The sealing connection between the sleeve 444 and the pressure chamber base 405 can be established via a fold 444*f*, in particular in the form of a double fold, as can be seen in the enlarged representations of the relevant section according to FIGS. 12*b* and 12*c*. The forces F and F' applied for forming the fold are shown.

The sleeve 444 and the pressure chamber base 405 have a sealing element 443*b* arranged therebetween.

The pressure chamber base 405 has applied thereto a (light) preload by pressing the pressure chamber base 405 in the direction of the container base 402. This is shown in FIG. 12*a* by a changed position (shown excessively large) of the pressure chamber base 405 and of the projection 405*b* relative to the container base 402 as pressure chamber base 405' and as its projection 405*b*'. A preload can improve the leakproofness of the connection.

The fold is formed in an example as follows hereinafter. A section of the pressure valve sleeve 444 projecting in the negative z-direction beyond the projection 405*b*' of the pressure chamber base 405' is bent in the positive r-direction over the projection 405*b*', on the entire circumference, so that a projection 442*b* of the pressure valve sleeve 444 will be formed. Subsequently, the bent projection 442*b* will be bent or folded further around the projection 405*b*' (on the entire circumference) so that the end of the projection 443*b* will be oriented in the positive z-direction. Then, the section of the sleeve 444 bent around the projection 405*b*' of the pressure chamber base 405' will be pressed by applying a force in the positive and/or negative r-direction.

Each of the pressure valves disclosed can be used in disclosed containers, hollow container bases or modular systems for producing a hollow container base, even if they are comprised by methods.

The disclosed fill chambers and pressure chambers can be used in all the disclosed containers, hollow container bases or modular systems for producing a container base, even if they are comprised by methods.

The invention claimed is:

1. A container for storing beer, comprising a fill chamber, a pressure chamber, and a pressure valve, wherein:

the fill chamber, having a first pressure and filled with the beer, is formed by a container base configured for supporting the container on a surface, a container wall extending from the container base toward a container upper face, a z-axis extending from the container base to the container upper surface;

the pressure chamber, having a second pressure, is formed by the container base and a pressure chamber base;

the pressure valve is connected to the container base and the pressure chamber base;

the pressure valve, when open, establishes fluid communication between the fill chamber and the pressure chamber, and the pressure valve, when closed, separates the fill chamber and the pressure chamber in a fluid-tight manner from one another; and a lower end of a discharge line located in the fill chamber is, with respect to the z-axis, not located above the pressure valve;

wherein:

an inner end section of the discharge line is located in the fill chamber; and the container base is configured to be dome-shaped or curved towards the fill chamber at least in an inner area of the container base, the inner area of the container base being above an outer portion of the container base adjacent the wall.

2. The container according to claim 1, wherein the pressure valve engages an opening of the container base and an opening of the pressure chamber base.

3. The container according to claim 1, wherein the pressure valve comprises a pressure valve body, and a first projection is arranged on an upper end of the pressure valve and a second projection is arranged on a lower end of the pressure valve, and wherein the first and second projections protrude in a radial direction beyond the radial dimensions of the pressure valve body at least along part of the circumference of the pressure valve body.

4. The container according to claim 3, wherein the first projection on the upper end of the pressure valve contacts the upper side of the container base and the second projection on the lower end of the pressure valve contacts the lower side of the pressure chamber base.

5. The container according to claim 1, wherein:

a first distance between the end of the inner section of the discharge line located in the fill chamber and a point on the pressure chamber base is smaller than a second distance between the end located in the fill chamber and an apex of the container base.

6. The container according to claim 1, wherein the container base is configured to be curved at least in an inner area of the container base or to be fully dome-shaped, and wherein an end of the discharge line is not positioned above an apex of the container base.

7. The container according to claim 1, wherein the pressure in the pressure chamber exceeds the pressure in the fill chamber by at least 1 bar.

8. The container according to claim 1, wherein the pressure chamber is filled with a propellant gas, the propellant gas comprising carbon dioxide ($CO_2$), nitrogen ($N_2$), nitrous oxide ($N_2O$) or mixtures thereof.

9. The container according to claim 1, wherein the pressure in the pressure chamber is between 5 bar and 35 bar, the pressure in the fill chamber is lower than the pressure in the pressure chamber, or both.

10. The container according to claim 1, wherein the volume of the pressure chamber is between 0.1 l and 5 l, the volume of the fill chamber is between 1 l and 25 l, or both.

11. The container according to claim 1, wherein the container base is configured to be curved at least in the inner area of the container base or virtually fully dome-shaped and extends into the container interior as the fill chamber.

12. The container according to claim 1, wherein the pressure chamber base is substantially planar.

13. The container according to claim 1, wherein a curvature of the container base in the direction of the interior of the container is provided such that in the edge area of the lower region of the fill chamber a small-area region is obtained so that residual amounts of liquid in the fill chamber are easily accessible by a discharge line and only a small amount of liquid cannot be removed.

* * * * *